US006270366B1

(12) United States Patent
Jeon et al.

(10) Patent No.: US 6,270,366 B1
(45) **Date of Patent: *Aug. 7, 2001**

(54) ADAPTABLE HIGH INTEGRATED ELECTRIC INTERCONNECTING SYSTEM

(75) Inventors: Myoung Soo Jeon, Anyang; Geol Hun Cho, Euwang; Young Pyo Hong, Suwon; Seong Joon Lee, Bucheon; Chang Ho Jung, Anyang, all of (KR)

(73) Assignee: LG Cable and Machinery Ltd., Seoul (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/277,357

(22) Filed: Mar. 26, 1999

(30) Foreign Application Priority Data

Oct. 14, 1998 (KR) ..... 98-43047

(51) Int. Cl.[7] ..... H01R 29/00
(52) U.S. Cl. ..... 439/170; 439/518
(58) Field of Search ..... 439/660, 626, 439/625, 620, 74, 170, 891, 518

(56) References Cited

U.S. PATENT DOCUMENTS 5,181,855 * 1/1993 Mosquera et al. ..... 439/74
5,575,686 11/1996 Noschese ..... 439/620
5,575,688 11/1996 Crane, Jr. ..... 439/660

* cited by examiner

*Primary Examiner*—Neil Abrams
*Assistant Examiner*—Michael C. Zarrdi
(74) *Attorney, Agent, or Firm*—Long Aldridge & Norman LLP

(57) ABSTRACT

The present invention relates to an plug-in type electric interconnecting system.

The electric interconnecting system according to the present invention is characterized in that it comprises a first fixed connecting member consisting of an insulation body and a plurality of projection-type conductor contact groups, the projection-type conductor contact groups being inserted in and fixed on the insulation body and disposed in rows and columns; a second fixed connecting member consisting of insulation body and a plurality of reception-type conductor contact groups, the reception-type conductor contact groups being inserted in and fixed on the insulation body and disposed in rows and columns to receive corresponding projection-type conductor contact groups; and an intermediate connecting member interposed between an external device to be connected and said second fixed connecting member to electrically interface the two; wherein the respective conductor contacts forming the conductor contact groups of said second fixed connecting member include joining portions to extend beyond said insulation body to thereby be electrically connected to said intermediate connecting member; and said intermediate connecting member is variable in its shape to correspond to said external device.

41 Claims, 26 Drawing Sheets

FIG. 1 0 A
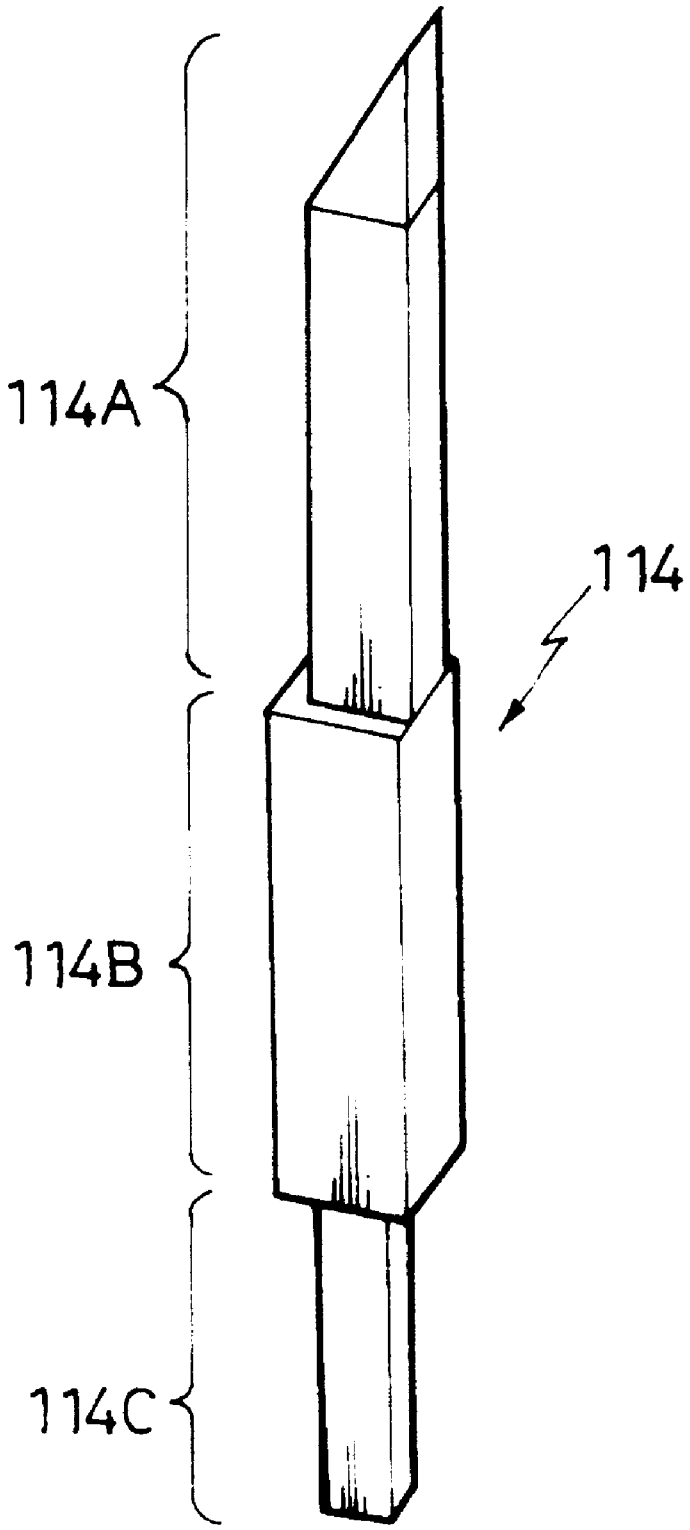

FIG. 1 0 B
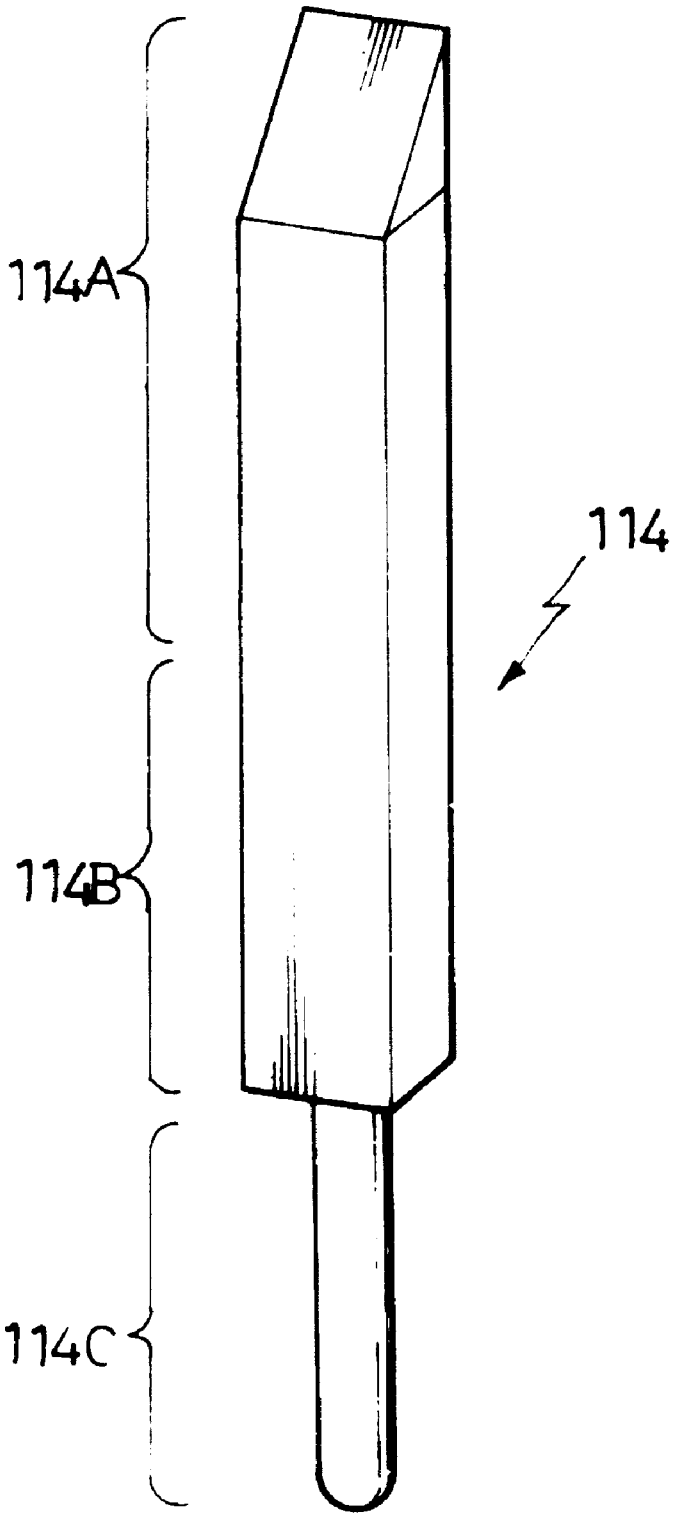

FIG. 1 4 A
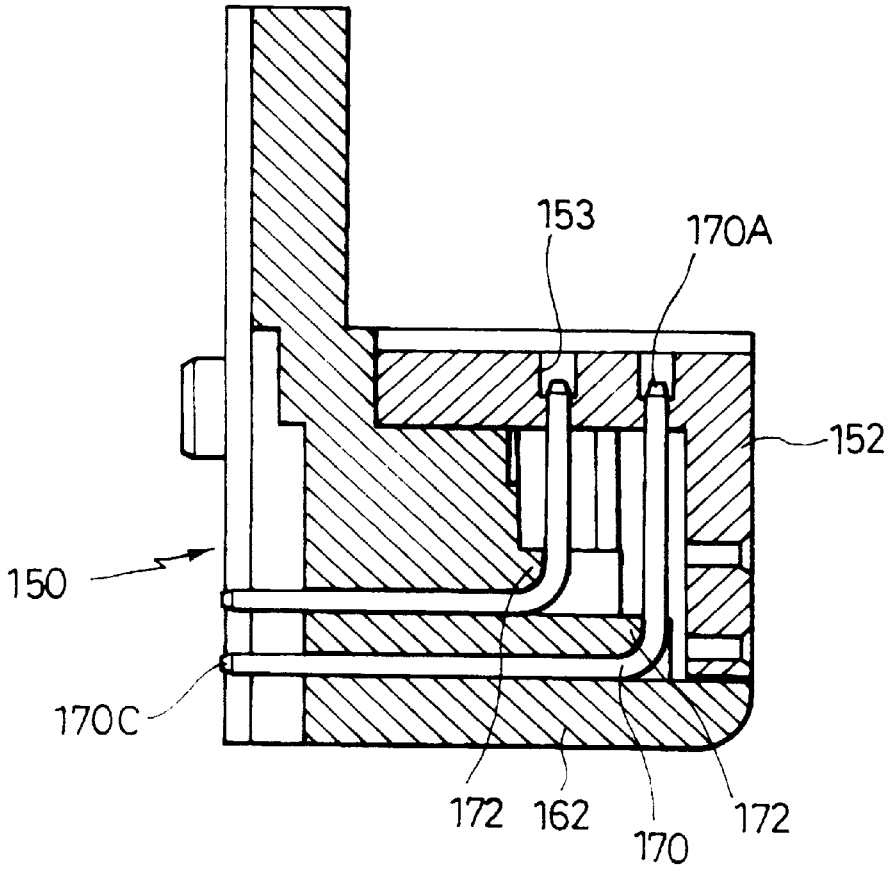
FIG. 1 4 B
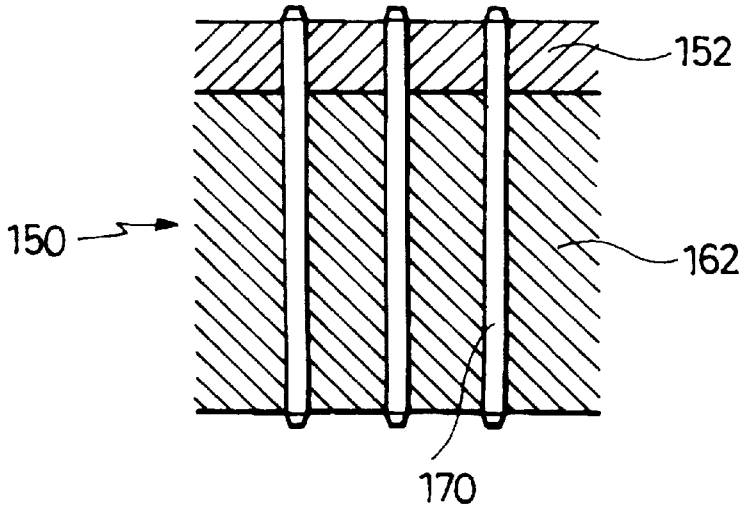

FIG. 1 4 C
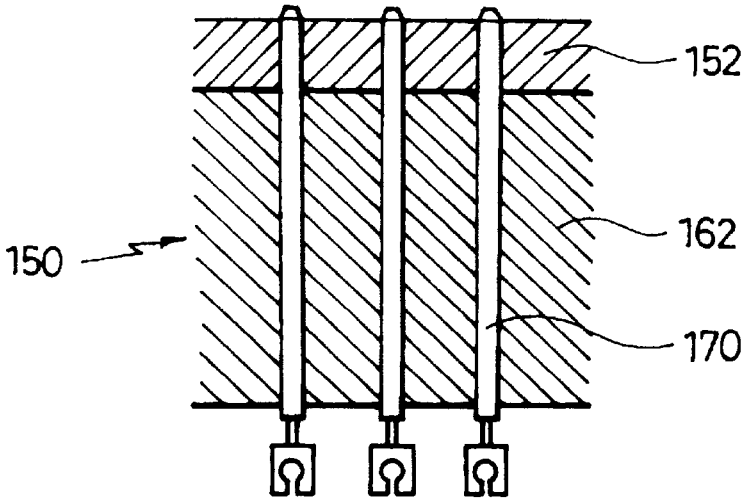
FIG. 1 5
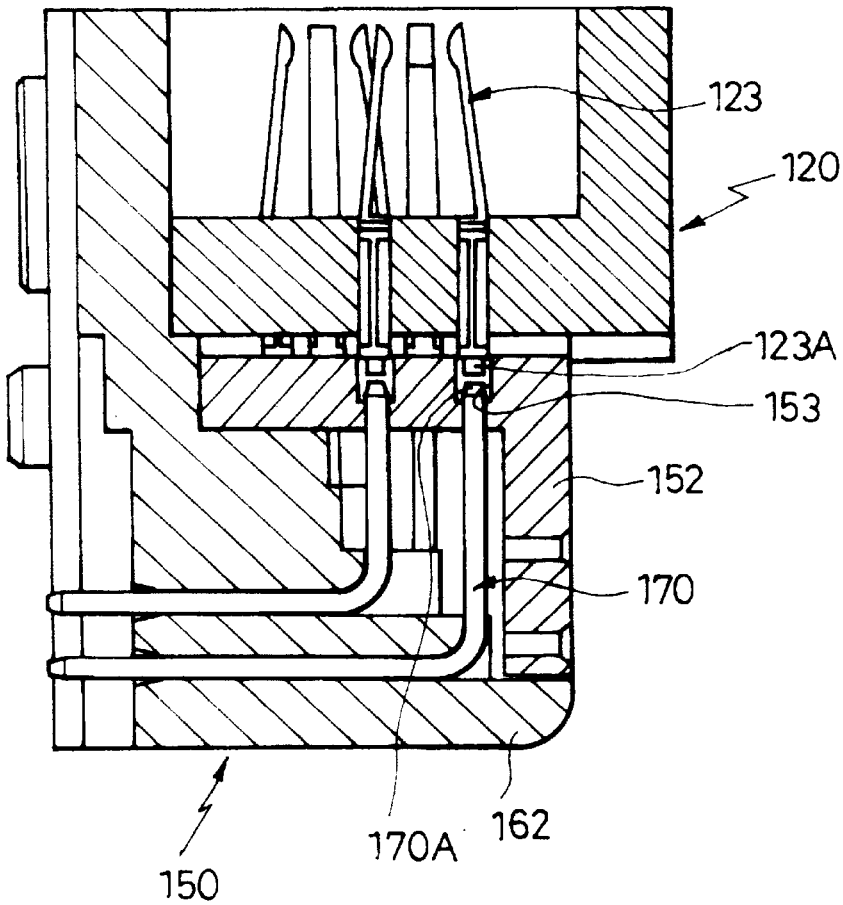

FIG. 1 9 A
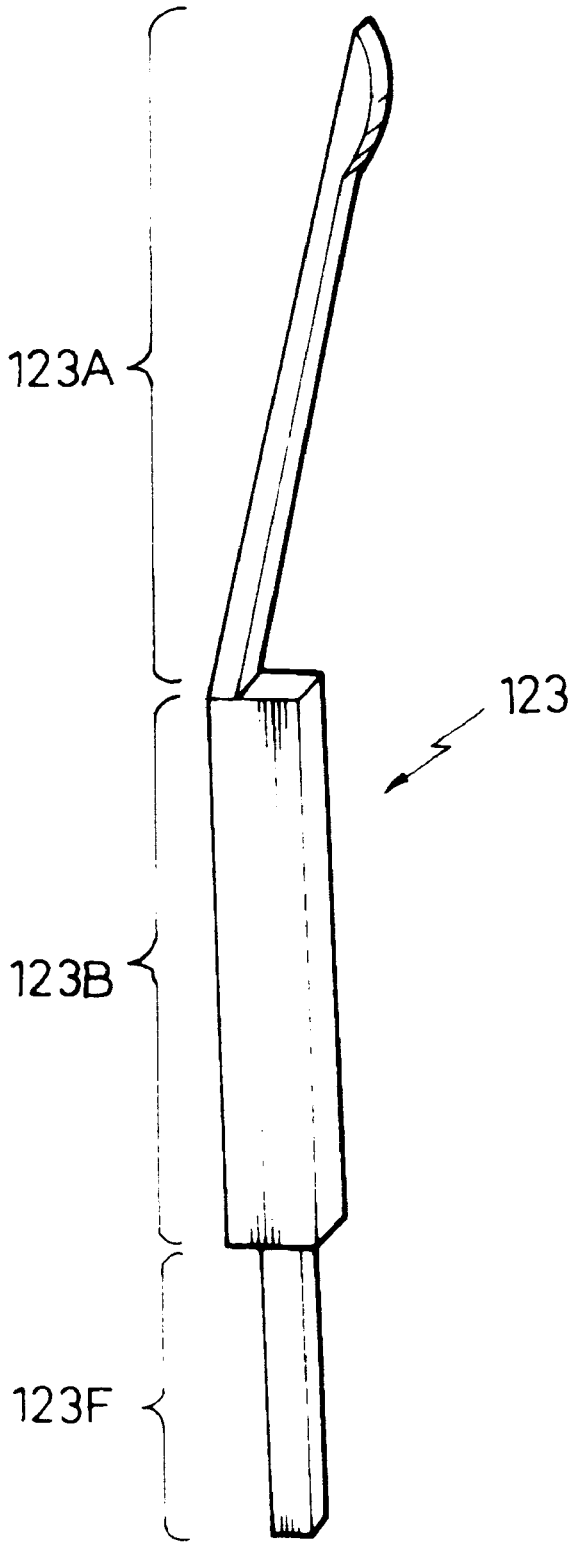

ADAPTABLE HIGH INTEGRATED ELECTRIC INTERCONNECTING SYSTEM

FIELD OF THE INVENTION

The present invention relates to a plug-in type electric interconnecting system and particularly to interconnecting components to be used for a plug-in type electric interconnecting system.

The present invention is particularly suited for a high integrated system but may also be applied to a high power system or other corresponding systems.

BACKGROUND OF THE INVENTION

Electric connector systems including electronic connector systems are used to interconnect electric or electronic systems as well as electric or electronic components.

Generally, an electric connector system includes a projection-type connector member such as a conductor beam and a reception-type connector member such as a conductor socket. In such a type of electric interconnecting system, an electric interconnection is achieved by inserting the projection-type connector member into the reception-type connector member. Such an insertion brings the projection-type connector member and the reception-type connector member into contact with each other at their conducting areas, so that an electric signal may be transmitted through those connector members.

In a conventional interconnecting system, for example, in the pin grid array shown in FIG. 1 which will be further discussed below, a multitude of individual conductor pins 11 are arranged on a grid structure 12 and a multitude of individual conductor sockets (not shown in FIG. 1) are arranged to receive the individual pins 11.

Here, each pair of the above pin and socket transmits a different electric signal.

A high integrated electric interconnecting system may be characterized by a great number of interconnecting contacts within a small area. Naturally, a high integrated electric interconnecting system has shorter signal paths than a low integrated electric interconnecting system and thus occupies a smaller space.

The short signal path in a high integrated electric interconnecting system enables a speedy transmission of electric signal.

Generally, a high integration of an electric interconnecting system improves performance of the system.

A lot of attempts have been made so far to realize high integration of an electric interconnecting system.

An example of the electric interconnecting systems so proposed is illustrated in FIG. 2*a*. The electric interconnecting system illustrated in FIG. 2*a* is known as the column and box type electric interconnecting system.

In the system shown in FIG. 2*a*, the projection-type interconnecting member 21 is a conductor beam or conductor column and the reception-type interconnecting member 22 is a conductor socket with a box form.

FIG. 2*b* shows the plan view for FIG. 2*a* in which the column is received in the socket.

As shown in FIG. 2*b*, the socket 22 includes, on its inner walls, the sections 23 and 24 protruding inward for fixing the column within the socket.

Another form of electric interconnecting system, which was also proposed, is shown in FIG. 3*a*. The electric interconnecting system shown in FIG. 3*a* is known as a single beam interconnecting system. In the system shown in FIG. 3*a*, the above-mentioned projection-type interconnecting member is the conductor pin or column 31 and the reception-type interconnecting member is the conductor flexible beam 32.

FIG. 3*b* shows the plan view for FIG. 3*a*. The flexible or elastic beam 32 is bent toward the column 31 to maintain the contact with the column 31.

The third type of conventional electric interconnecting system as proposed is shown in FIG. 4*a*. The electric interconnecting system shown in FIG. 4*a* is known as an edge connector system.

The projection-type interconnecting member of the edge connector system is composed of an insulated printed circuit board 41 and conductor patterns 43 formed on the opposite sides of the printed circuit board. The reception-type interconnecting members of the edge connector system comprise a set of upper conductor fingers and a mating set of under conductor fingers 42 to grip the printed circuit board 41 between the upper and lower sets of fingers.

FIG. 4*b* shows an elevation view for FIG. 4*a*, in which the printed circuit board 41 is interposed between an upper and lower fingers 42. When the printed circuit board 41 is interposed between the above-mentioned conductor fingers 42, the respective conductor patterns 43 come in contact with the corresponding conductor fingers 42, whereby the electric signals can be transmitted through the conductor patterns 43 and the conductor fingers 42.

The fourth type of conventional electric interconnecting system as proposed is shown in FIG. 5. The electric interconnecting system shown in FIG. 5 is known as pin and socket interconnecting system.

In the system shown in FIG. 5, the above-mentioned projection-type interconnecting member is the conductible stamped pin 51 and the reception-type interconnecting member is the conductible slotted socket 52.

The socket 52 is typically mounted in a through hole formed on a printed circuit board. The pin 51 is larger in size in comparison to the slotted space formed inside the socket 52. Such a dimension of larger pin is intended to secure the pin 51 in the socket 52 tightly with the aid of elasticity.

The interconnecting systems shown in FIGS. 1 to 5 are all defective somehow on various grounds.

For example, the interconnecting members of those systems generally include metal platings on the outer surface and inner surface of the projection-type and reception-type member to ensure enough electric contact between the interacting members. Because such a metal plating is typically realized through gold or other expensive metals, the systems shown in FIGS. 1 to 5 can be manufactured only at a high cost.

The edge connector system of FIG. 4 has the drawback of its capacity and susceptibility to electromagnetic interference.

Similarly, the pin and socket system of FIG. 5 not only requires a big force to insert the pin into the slotted socket but also allows only small tolerance to thereby make adequate fixing difficult.

Major problems in connection with the systems shown in FIGS. 2 and 3(when they are arranged as in FIG. 1), the system shown in FIG. 4(when it is arranged in a row) and the system shown in FIG. 5(when it is arranged as in FIG. 4*a*), reside in that those systems are not proper for integration which is needed for the technology of future semiconductors and computers.

As an attempt to solve such a problem of integration, there was proposed a high integrated interconnecting system by U.S. Pat. No. 5,575,686.

The construction for this high integrated interconnecting system is shown in FIGS. 6*a*–6*c*. The high integrated interconnecting system of this patent includes a projection-type interconnecting member 61 and a reception-type interconnecting member 62.

The above-described projection-type interconnecting member 61 comprises an insulated substrate 63, conductor posts 65 and insulated buttresses 67 supporting the conductor posts. The conductor posts 65, which are arranged around a buttress 67, are engaged with the conductor beams 64 of the corresponding reception-type interconnecting member 62. Further, the foot sections 65A of the conductor posts 65 have a variety of forms depending on the types of interface devices(not shown) to be connected. The conductor posts 65 with the rectangular foot sections 65A as shown in FIG. 6*a* are well adapted for electric connection of the printed circuit boards positioned at a right angle.

In addition, the reception-type interconnecting member 62, which consists of an insulated substrate 66 and plural conductor beams 64 attached on the insulated substrate 66, receives the projection-type interconnecting member 61 for transmission of electric signals.

The conductor beams 64 of the reception-type interconnecting member 62 has a shape as seen in FIG. 6*b*. In particular, the conductor beam 64 largely consists of the contacting part 64A, the fixed part 64B and the foot part 64C.

The contacting part 64A consists of a guiding zone 64AA for guiding a conductor post 65 and an interface zone 64AB for forming electric contact with the conducting part of a conductor post, so that the conductor posts of the corresponding projection-type interconnecting member 61 may be received in the contacting parts 64A.

The fixing part 64B is a part at which the conductor beam 64 is fixed and supported on an insulated substrate 66.

The foot part 64C by which the conductor beam 64 is bound to an interface device has different shapes depending on the types of interface devices. In other words, the foot parts 64C shown in FIG. 6*b* may be applicable where two printed circuit boards are connected with other, while the arrangement shown in FIG. 6*c* illustrates foot parts 64C for the case that the conductor beams 64 of a reception-type member 62 are combined with wires or cables 68.

As described above, in the conventional high integration interconnecting system, each individual manufacture of reception-type interconnecting members 62 and projection-type interconnecting members 61 was needed according to the particular types of devices, for example, a semiconductor chip, a printed circuit board, a wire, a round cable, a flat flexible cable or the like, to which a projection-type interconnecting member 61 and a reception-type interconnecting member 62 are connected. Therefore, a problem was caused in that the manufacture was difficult and the manufacturing cost was conventional.

In other words, one disadvantage of that configuration is the reception-type interconnecting member and the projection-type interconnecting member had to be manufactured variedly, depending on whether a board is connected to a board, whether a board is connected to a wire or whether a cable is connected to a cable, in an electric interconnecting system.

SUMMARY OF THE INVENTION

The present inventors found that the problem associated with the conventional high density electric interconnecting system was caused by the lack of active adaptability to connecting environment due to the integral construction of connecting members, which electrically connect the external devices together.

Accordingly, there was perceived a need for an electric interconnecting system, which can be easily adapted for the change of connecting environment without altering the basic configuration of the projection-type interconnecting member and reception-type interconnecting member even in the case of change of a device to be connected.

As the result, the present inventors developed a fixed or permanent connecting means having a fixed shape independent of the type of a device to be connected and a intermediate connecting means which can vary in its shape according to the type of another device to be connected so as to mediate between the fixed connecting means and another device.

The object of the present invention is to provide an electric interconnecting system which can be adapted easily and actively for the interconnecting environment even if there is a change.

Another object of the present invention is to provide an electric interconnecting system which is simple in the manufacture and low in the manufacturing cost.

A further object of the present invention is to provide an electric interconnecting system which is easy in the change of design in response to the interconnecting environment.

The above objects are achieved by the electric interconnecting system according to the first aspect of the present, invention. The first aspect of the present invention includes a first fixed connecting member having an insulation body and a plurality of projection-type conductor contact groups. The projection-type conductor contact groups are inserted in and fixed on the insulation body and disposed in rows and columns. The first aspect of the present invention also includes a second fixed connecting member having of insulation body and a plurality of reception-type conductor contact groups, the reception-type conductor contact groups being inserted in and fixed on the insulation body and disposed in rows and columns to receive corresponding projection-type conductor contact groups. The first aspect of the present invention also includes an intermediate connecting member interposed between an external device to be connected and said second fixed connecting member to electrically interface the two; wherein the conductor contacts forming the conductor contact groups of said second fixed connecting member include joining portions to extend beyond said insulation body to thereby be electrically connected to said intermediate connecting members. Said external device and another external device are electrically separated and are electrically connectable to each other by causing the projection-type conductor contact groups of the first fixed connecting member to be fixedly received in the reception-type conductor contact groups of the second fixed connecting member and causing the intermediate connecting member to be interposed between the second fixed connecting member and said external device to connect the two. Said intermediate connecting member is variable in its shape to correspond to said external device.

The second aspect of the present invention resides in that the electric interconnecting system comprises: a first fixed connecting member consisting of an insulation body and a plurality of projection-type conductor contact groups, the projection-type conductor contact groups being inserted in and fixed on the insulation body and disposed in rows and columns; a second fixed connecting member having an insulation body and a plurality of reception-type conductor contact groups, the reception-type conductor contact groups being inserted in and fixed on the insulation body and disposed in rows and columns to receive corresponding projection-type conductor contact groups; and an intermediate connecting member interposed between an external device to be connected and said first fixed connecting member to electrically interface the two; wherein the conductor contacts forming the conductor contact groups of said first fixed connecting member include joining portions to extend beyond said insulation body to thereby be electrically connected to said intermediate connecting member; said external device and another external device electrically separated are electrically connectable to each other by causing the projection-type conductor contact groups of the first fixed connecting member to be fixedly received in the reception-type conductor contact groups of the second fixed connecting member and causing the intermediate connecting member to be interposed between the first fixed connecting member and said external device to connect the two; and said intermediate connecting member is variable in its shape to correspond to said external device.

Third aspect of the present invention also capable of achieving the above object resides in that the electric interconnecting system comprises: a first fixed connecting member consisting of an insulation body and a plurality of projection-type conductor contact groups, the projection-type conductor contact groups being inserted in and fixed on the insulation body and disposed in rows and columns; a second fixed connecting member having an insulation body and a plurality of reception-type conductor contact groups, the reception-type conductor contact groups being inserted in and fixed on the insulation body and disposed in rows and columns to receive corresponding projection-type conductor contact groups; a first intermediate connecting member interposed between an external device to be connected and said first fixed connecting member to electrically interface the two; and a second intermediate connecting member interposed between another external device to be connected and said second fixed connecting member to electrically interface the two; wherein the respective conductor contacts forming the conductor contact groups of said first and second fixed connecting members include joining portions to extend beyond the respective insulation bodies to thereby be electrically connected to said first and second intermediate connecting members; said external device and another external device electrically separated are electrically connectable to each other by causing the projection-type conductor contact groups of the first fixed connecting member to be fixedly received in the reception-type conductor contact groups of the second fixed connecting member and causing the first and second intermediate connecting members to be interposed between the first and second fixed connecting members on one side and said external and another external devices on the other side to thereby electrically combine them; and said first and second intermediate connecting member are each variable in its shape to correspond to said external or another external device.

The other objects and advantages of the present invention will be understood from the following description in detail on the embodiments of the invention with reference to the attached drawings. Particularly, the objects and advantages of the invention may be realized through the means and their combinations described in the appended claims.

BRIEF DESCRIPTION OF THE DRAWINGS

FIG. 12 shows the second fixed connecting member in cross section along line IV—IV in FIG. 11, FIG. 13 shows an enlarged perspective view of a flexible beam applicable to the second fixed connecting member as depicted in FIGS. 11 and 12, FIG. 14*a* shows the intermediate connecting member in cross section along line III—III in FIG. 7, FIGS. 14*b* and 14*c* show the intermediate connecting members as depicted in FIG. 7 in cross section according to other embodiments, FIG. 15 shows the cross section of the second fixed connecting member and the intermediate connecting member as depicted in FIG. 7 in their assembled state, FIG. 16 shows the enlarged perspective view of the conductor pin as depicted in FIG. 14*a,*

FIG. 17 shows the exploded perspective view of the electric interconnecting system according to the second embodiment of the invention, FIG. 18 shows the enlarged perspective view of a conductor post applicable to the first fixed connecting member as depicted in FIG. 17, FIGS. 19*a* to 19*c* each show an enlarged perspective view of a flexible beam applicable to the second fixed connecting member as depicted in FIG. 17, FIG. 20 shows the exploded perspective view of the electric interconnecting system according to the third embodiment of the invention, FIG. 21 shows an enlarged perspective view of a conductor post applicable to the first fixed connecting member as depicted in FIG. 20

DETAILED DESCRIPTION OF THE INVENTION

In the following, a few preferred embodiments of the present invention will be described with reference to the attached drawings which constitute a part of the specification and which act to illustrate the principle of the invention.

First, the first embodiment of the present invention will be described by referring to FIGS. 7 to 16.

The First Embodiment.

Figure 1:
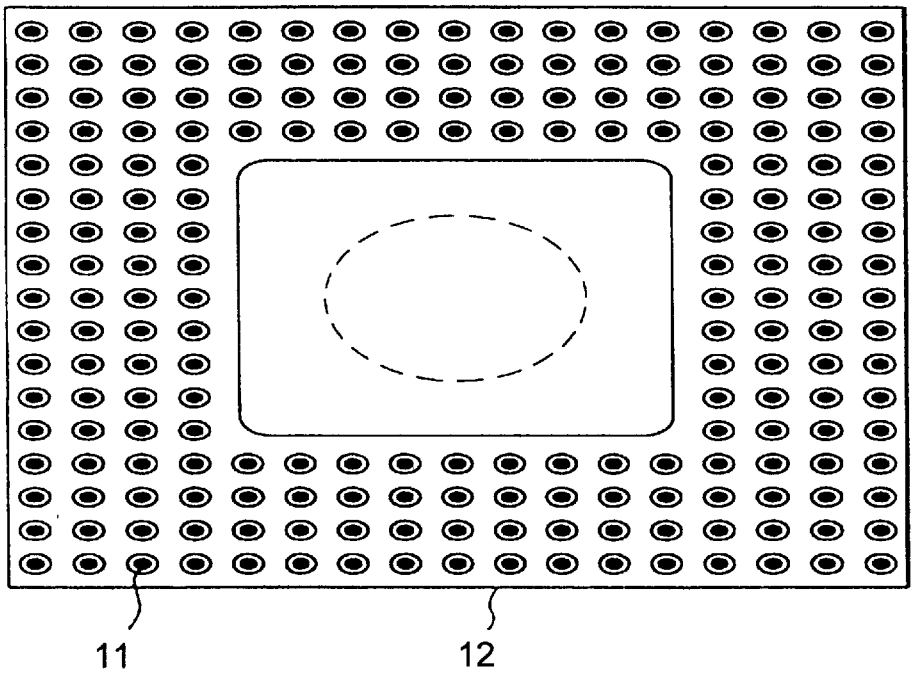
FIG. 1 PRIOR ART
FIG. 1 shows a plan of a conventional pin grid array.
Figure 2A:
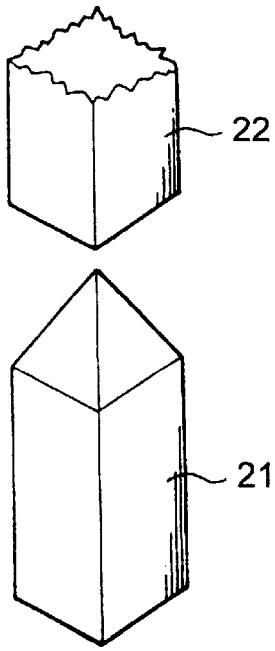
FIG. 2A PRIOR ART
FIG. 2*a* shows a perspective view to illustrate a conventional column type electric interconnecting system.
Figure 2B:
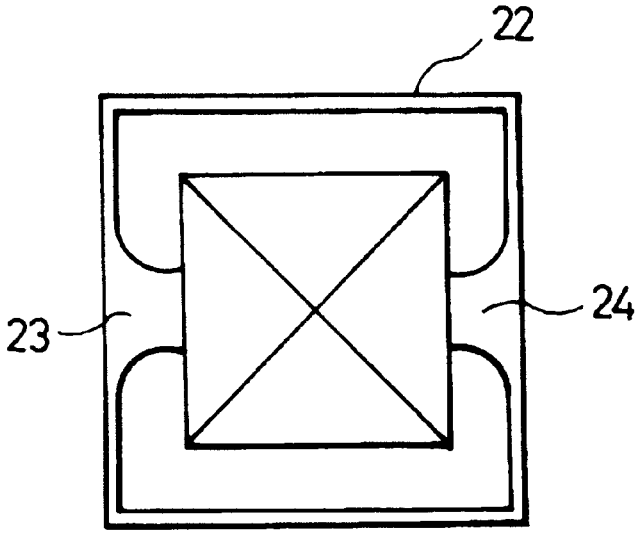
FIG. 2B PRIOR ART
FIG. 2*b* shows the plan of the conventional column type electric interconnecting system depicted in FIG. 2*a,*
Figure 3A:
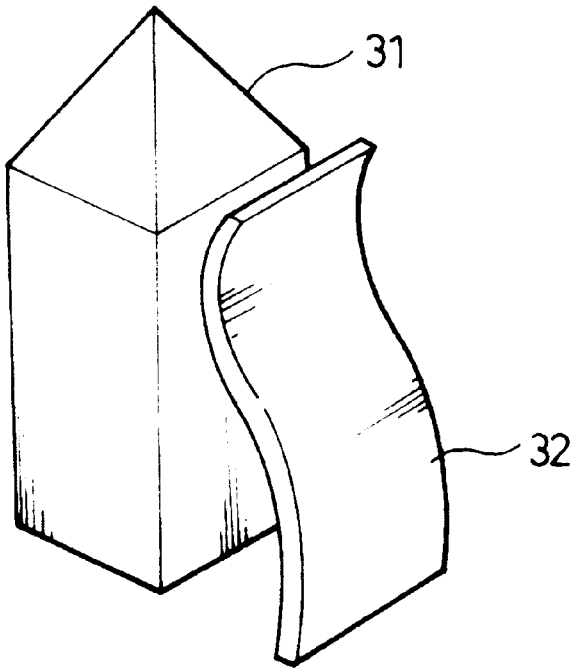
FIG. 3A PRIOR ART
FIG. 3*a* shows a perspective view to illustrate a conventional single beam electric interconnecting system.
Figure 3B:
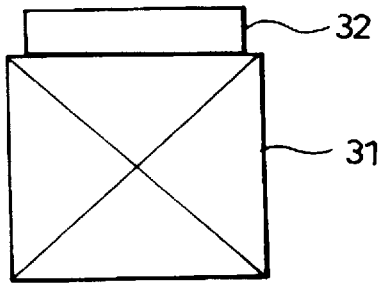
FIG. 3B PRIOR ART
FIG. 3*b* shows the plan of the conventional single beam electric interconnecting system depicted in FIG. 3*a,*
Figure 4A:
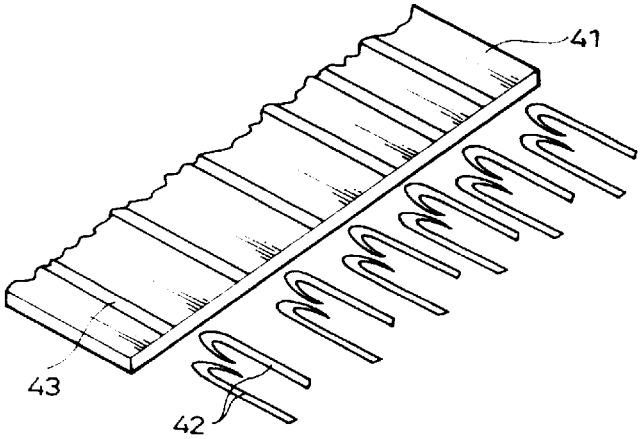
FIG. 4A PRIOR ART
FIG. 4*a* shows a perspective view to illustrate a conventional edge connector system.
Figure 4B:
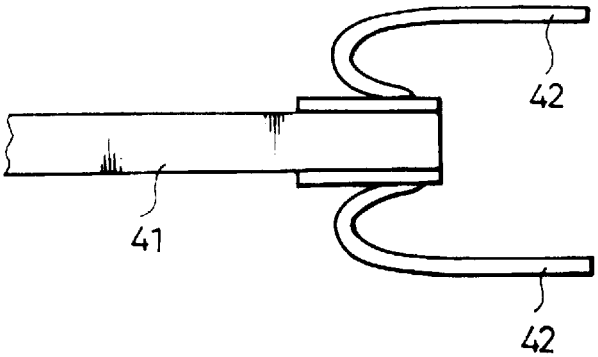
FIG. 4B PRIOR ART
FIG. 4*b* shows the elevation view of the electric interconnecting system depicted in FIG. 4*a,*
Figure 5:
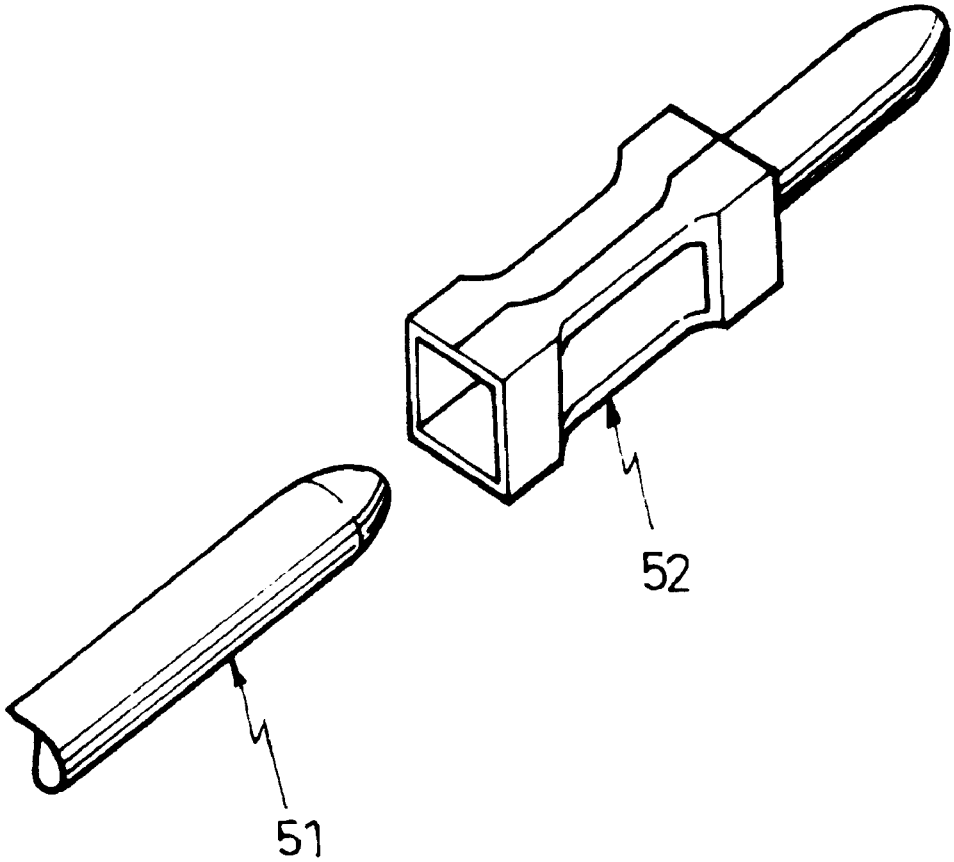
FIG. 5 PRIOR ART
FIG. 5 shows a perspective view to illustrate a conventional pin-and-socket type electric interconnecting system.
Figure 6A:
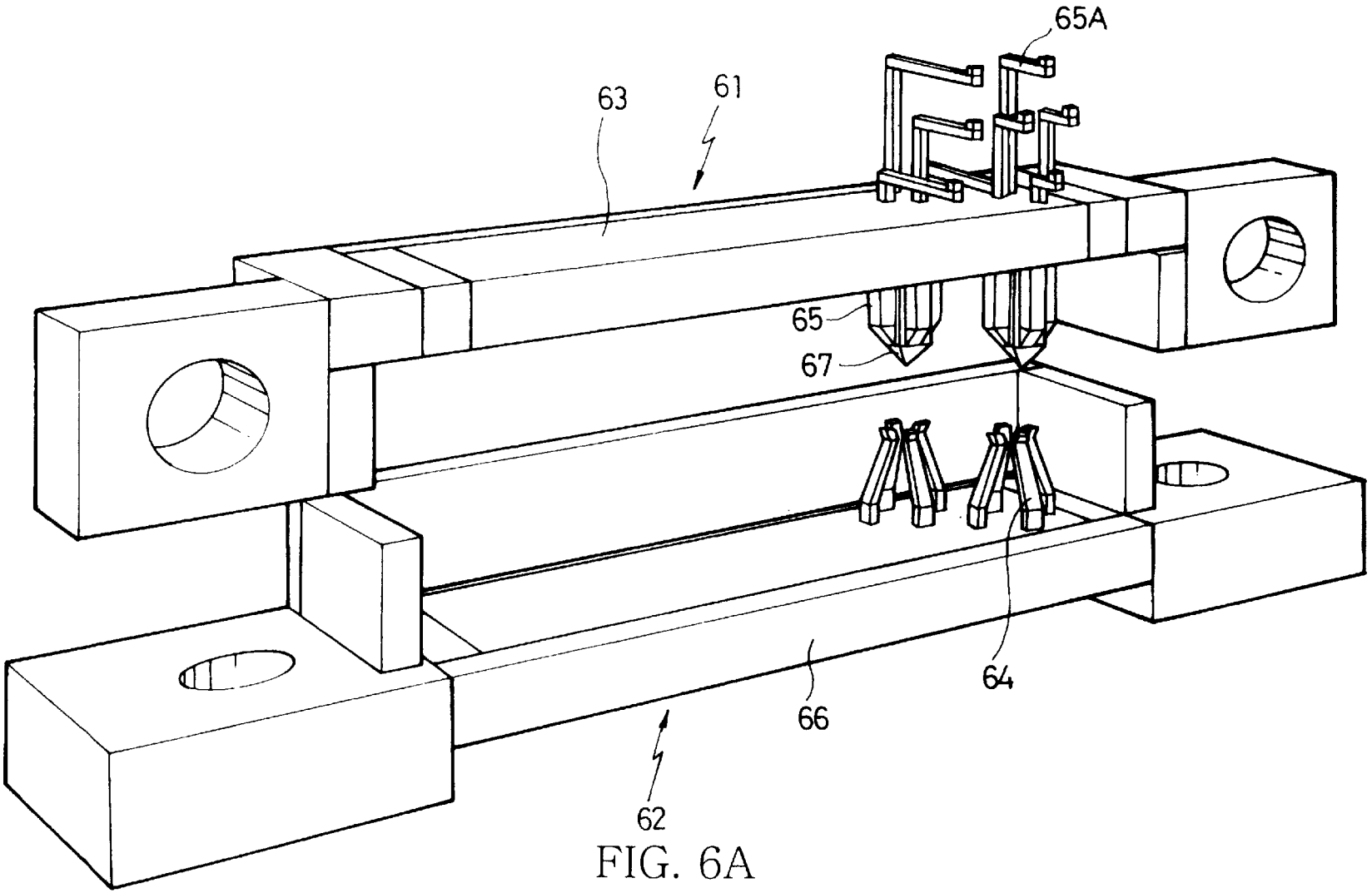
FIG. 6A PRIOR ART
FIG. 6*a* shows a exploded perspective view to illustrate a conventional high density interconnecting system.
Figure 6B:
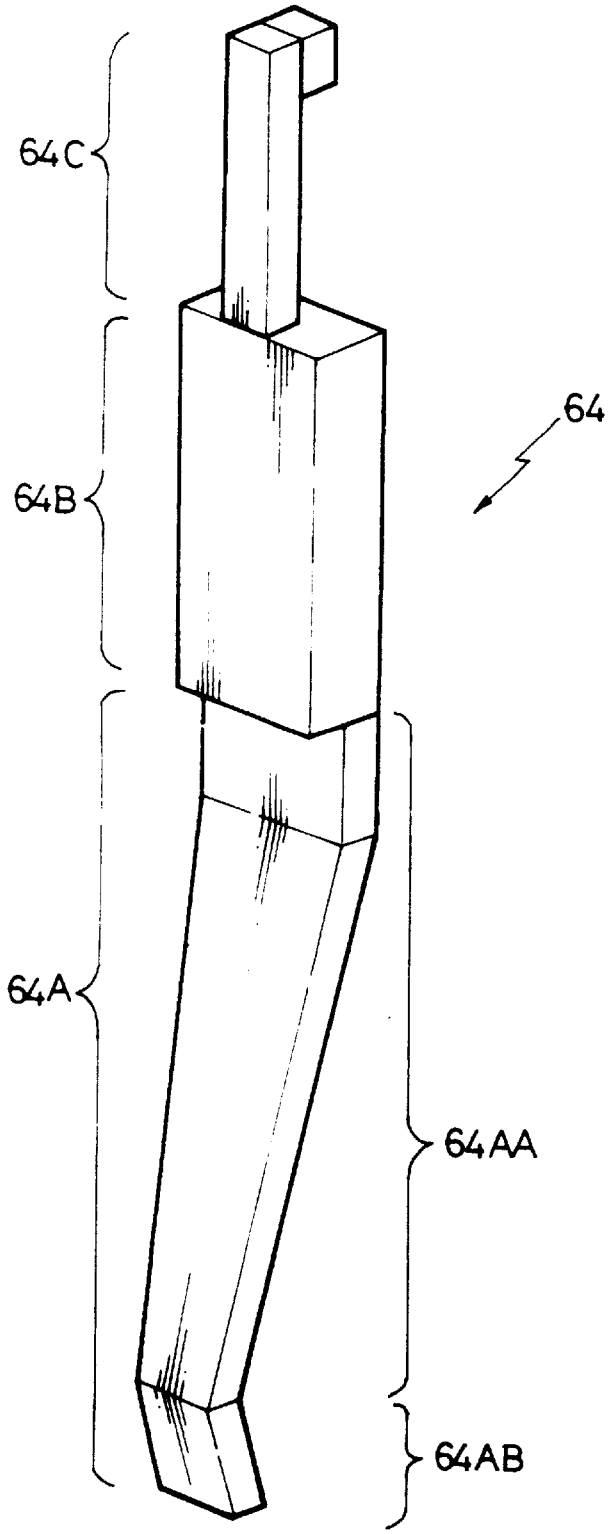
FIG. 6 B PRIOR ART
FIG. 6*b* shows an enlarged perspective view of an example of conductor beam applicable to the high density interconnecting system depicted in FIG. 6*a,*
Figure 6C:
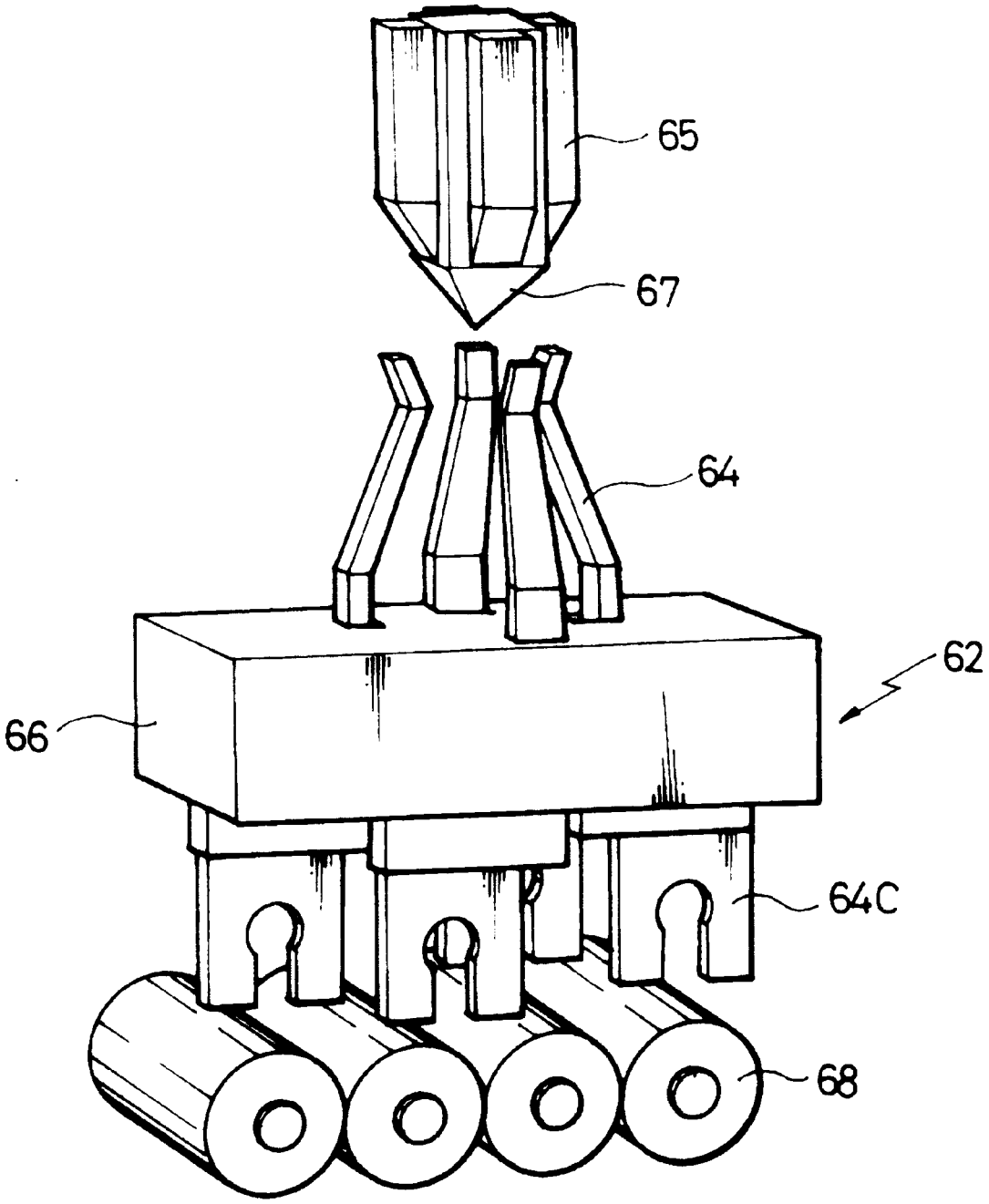
FIG. 6 C PRIOR ART
FIG. 6*c* shows an enlarged perspective view of another example of conductor beams applicable to the high density interconnecting system depicted in FIG. 6*a,*
Figure 7:
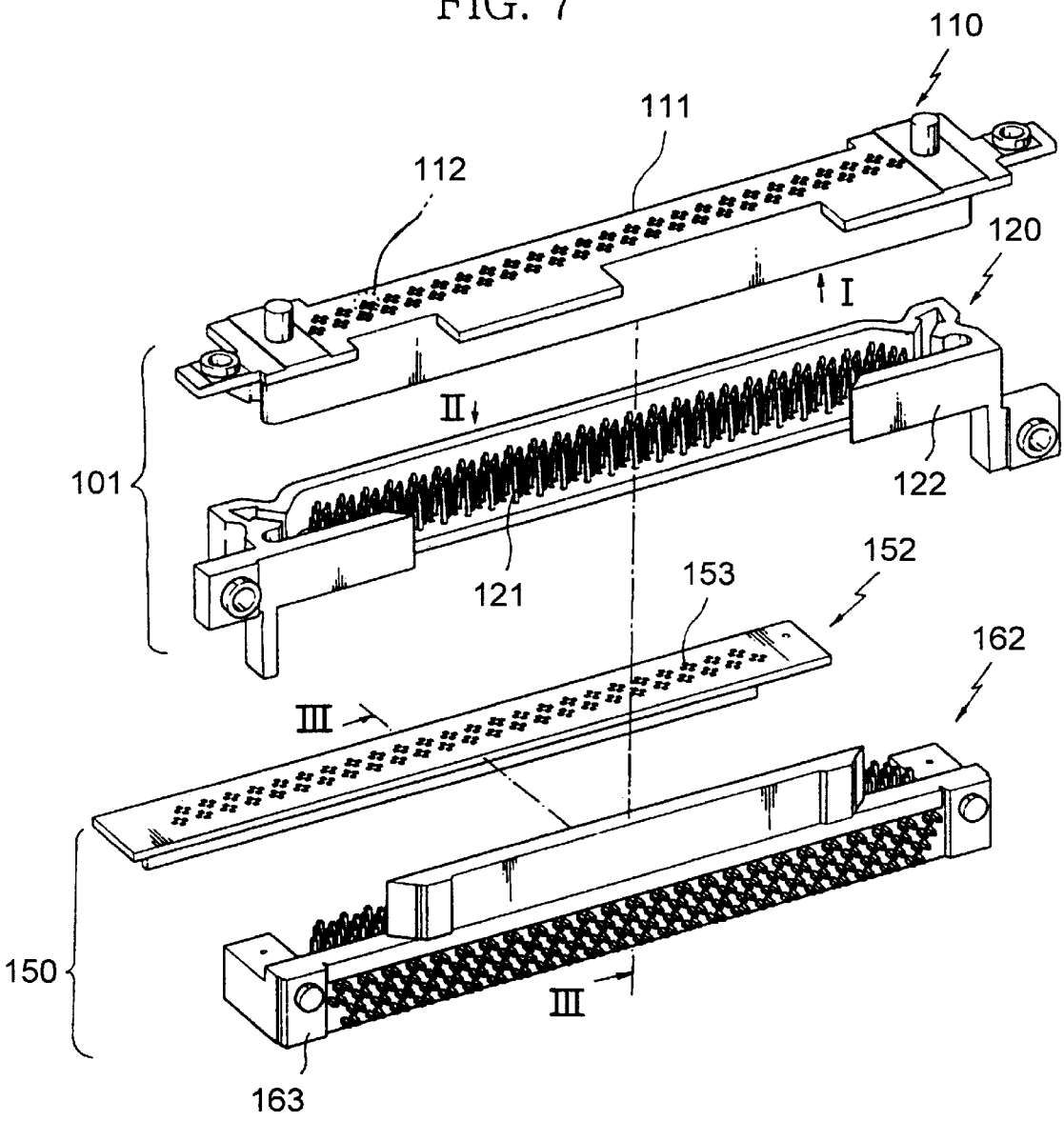
FIG. 7 shows an exploded perspective view of the electric interconnecting system according to the first embodiment of the present invention.

FIG. 7 shows the exploded perspective view of the electric interconnecting system according to the first embodiment of the invention.

As shown in FIG. 7, this system consists of a fixed connecting member 101 and a intermediate connecting member 150. The fixed connecting member 101 itself includes the first fixed connecting member 110 and the second fixed connecting member 120. The intermediate connecting member 150 itself includes a guiding connecting cover 152 and a intermediate connecting member 162.

The intermediate connecting member 150 is positioned between the second fixed connecting member 120 and a device to be connected, including a printed circuit board, wire, semiconductor chip, round cable, flat flexible cable and the like(not shown).

Thus, between the devices to be bound, the first fixed connecting member 110, the second fixed connecting member 120 and the intermediate connecting member 150 are arranged in that order.

The second fixed connecting member 120 has a permanently constant construction regardless of the type of the device to be connected. On the other hand, the first fixed connecting member 110 needs to vary in the shape of is connecting area or to be changed according to the type of the device to be connected.

Therefore, this embodiment would be useful for the case where an external device to be connected to the first fixed connecting member 110 is fixed or definite and a device to be connected to the second fixed connecting member(120) varies.

When the external connecting device which is connected to the first fixed connecting member 110 is a printed circuit board for example and the shape of the intermediate connecting member 150 which is connected to the second fixed connecting member 120 is designed as in FIG. 14*a*, a vertical type board-to-board connection is resulted. When the shape of the intermediate connecting member 150 is designed as in FIG. 14*b*, there is resulted a horizontal type board-to-board connection. In addition, When the shape of the intermediate connecting member 150 is designed as in FIG. 14*c*, there is resulted a board-to-wire connection.

As can be understood from the above, the intermediate connecting member 150 may vary freely in its construction according to the type of the external device to be ultimately connected to the second fixed connecting member 120.

Figure 8:
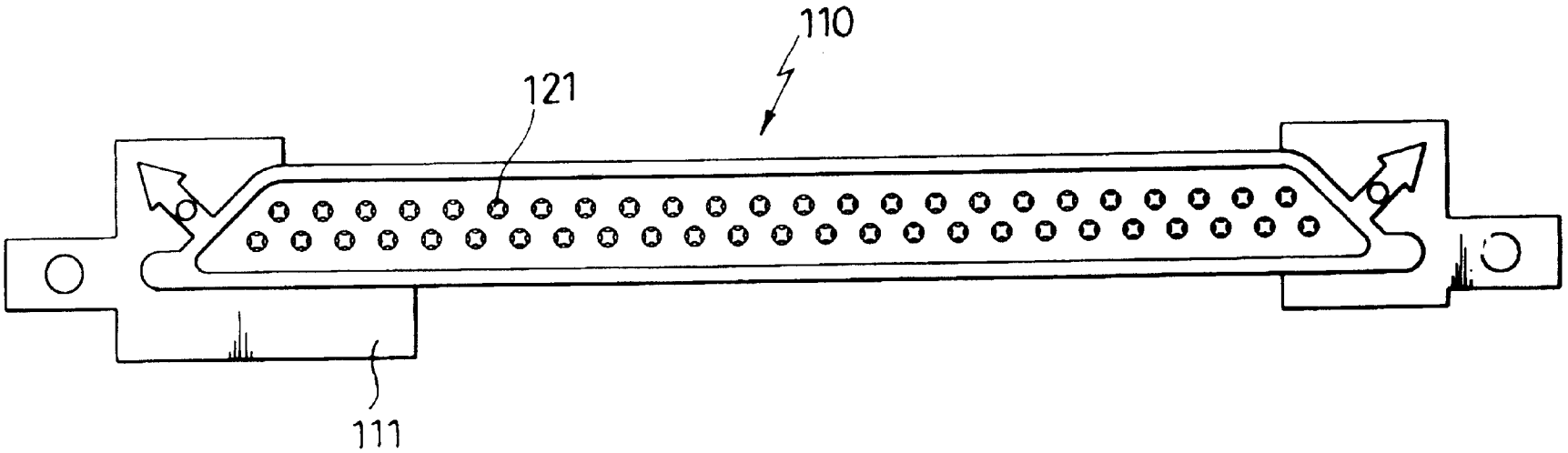
FIG. 8 shows a plan of the first fixed connecting member shown in FIG. 7, as viewed from the direction I.
Figure 9:
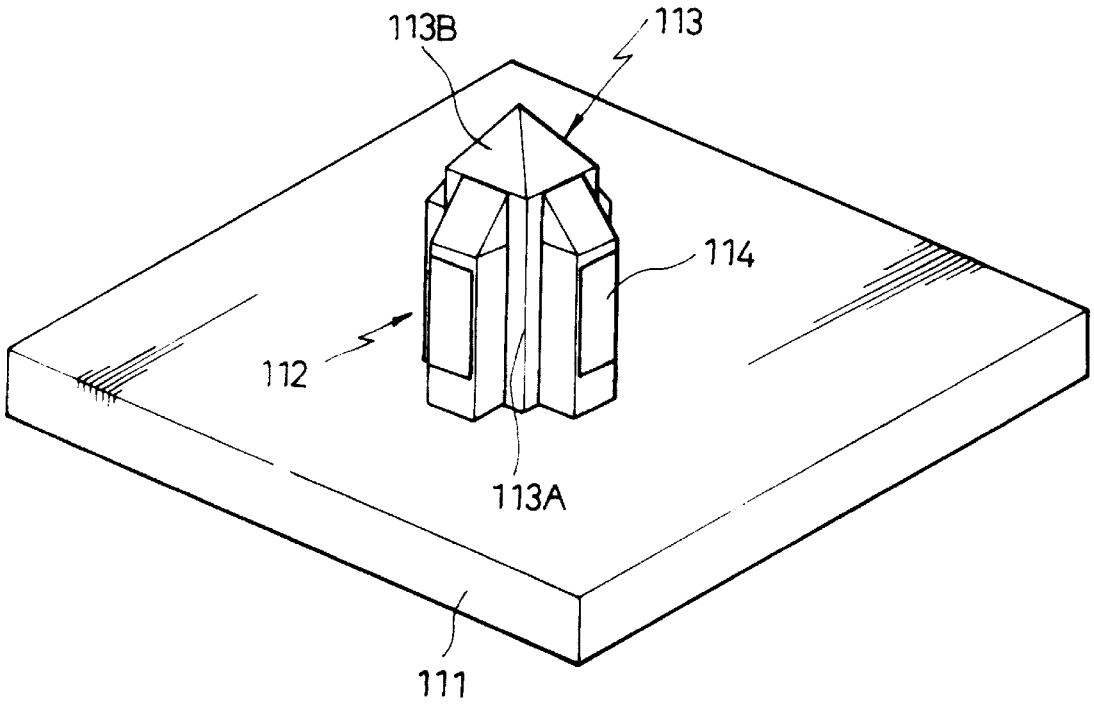
FIG. 9 shows a partial perspective view to illustrate the projection-type conductor contact group depicted in FIG. 8, FIGS. 10*a* to 10*c* each show a perspective view of a conductor post as seen from FIG. 9 to illustrate some variants.

Referring to FIGS. 8 to 10, the first fixed connecting member 110 according to this first embodiment is described.

As seen in FIG. 7, the first fixed connecting member 110 includes an insulation body 111 and a plurality of projection-type conductor contact groups 112 which are inserted in and secured on the insulation body.

Figure 11:
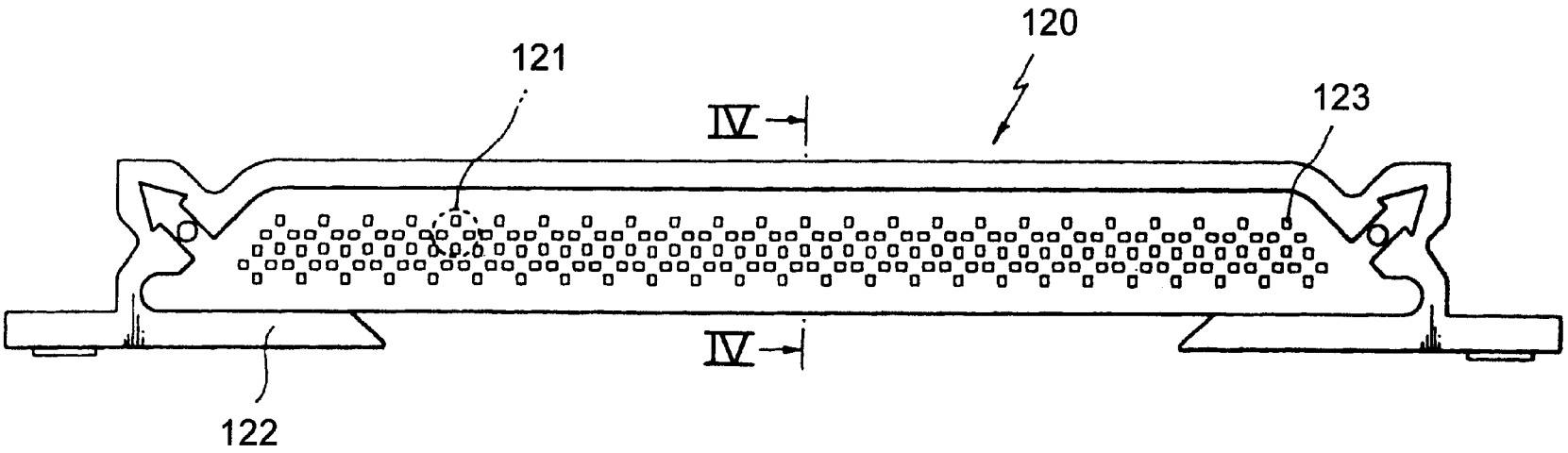
FIG. 11 shows a plan of the second fixed connecting member shown in FIG. 7, as viewed from the direction II.
Figure 1:
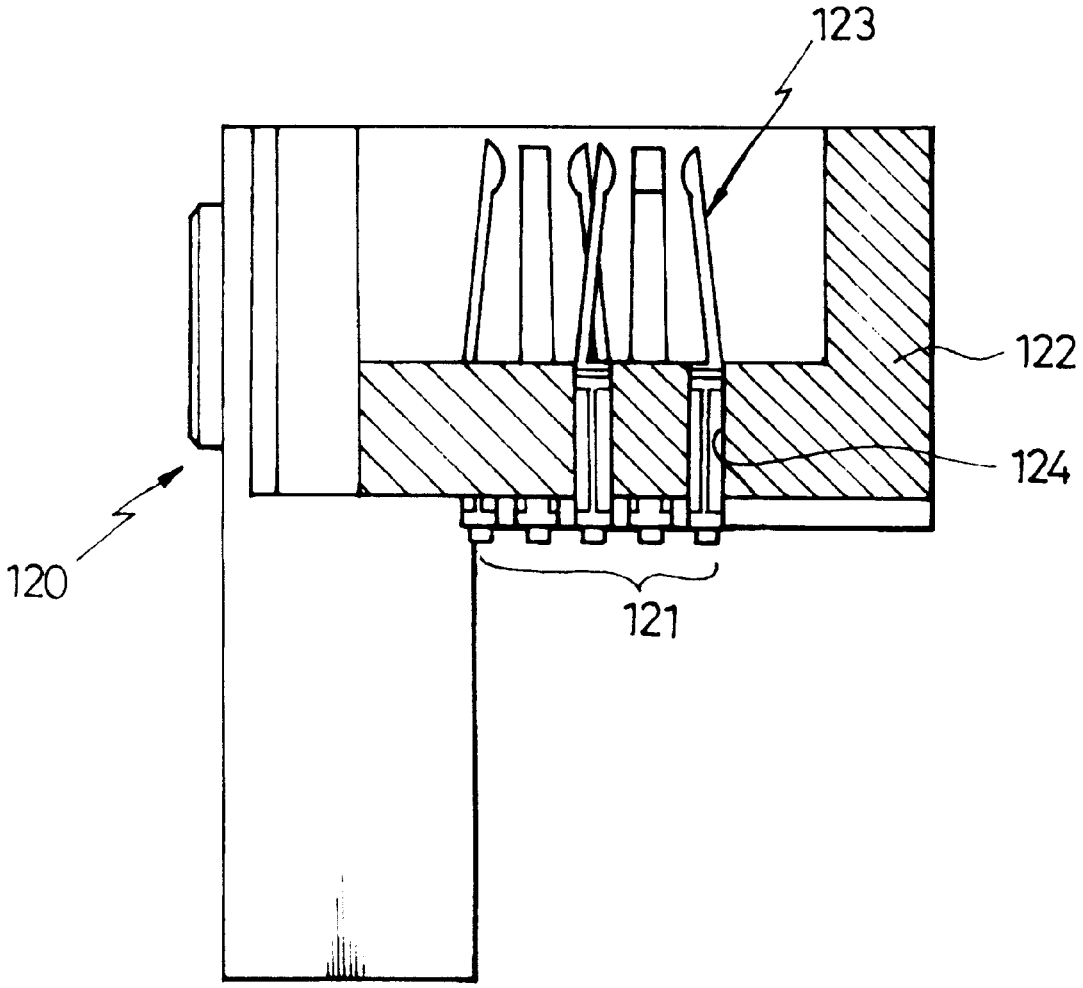
Figure 1:
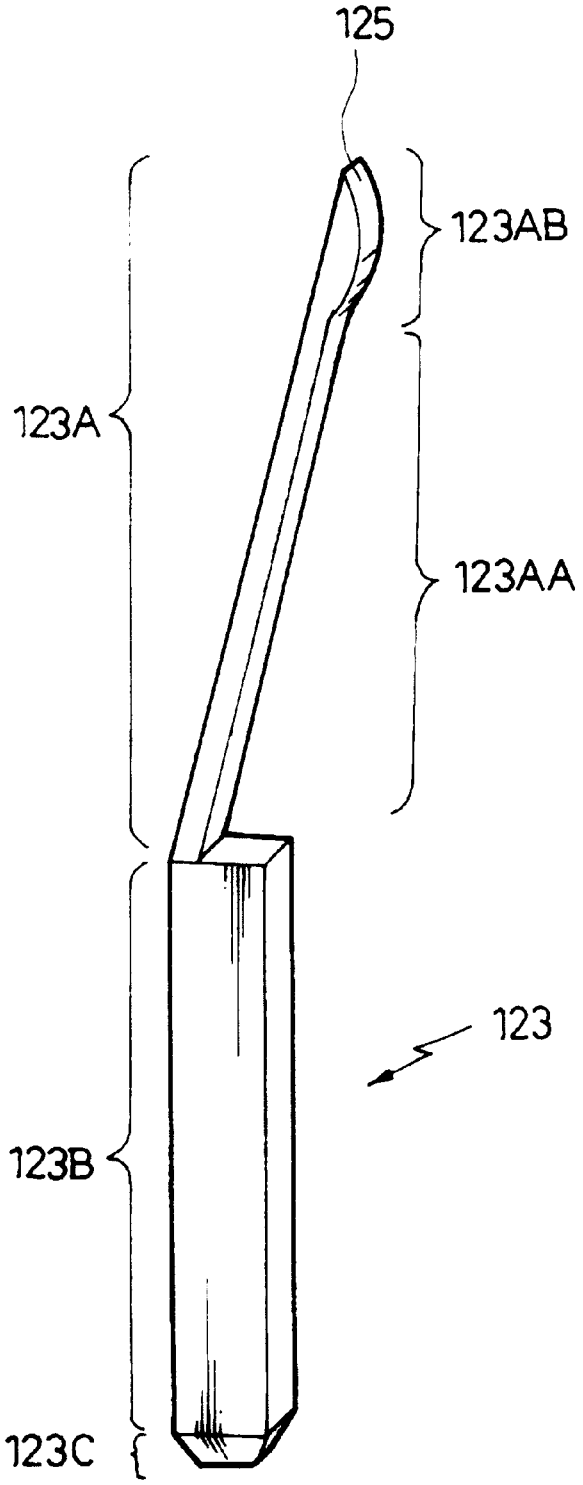
Figure 1:
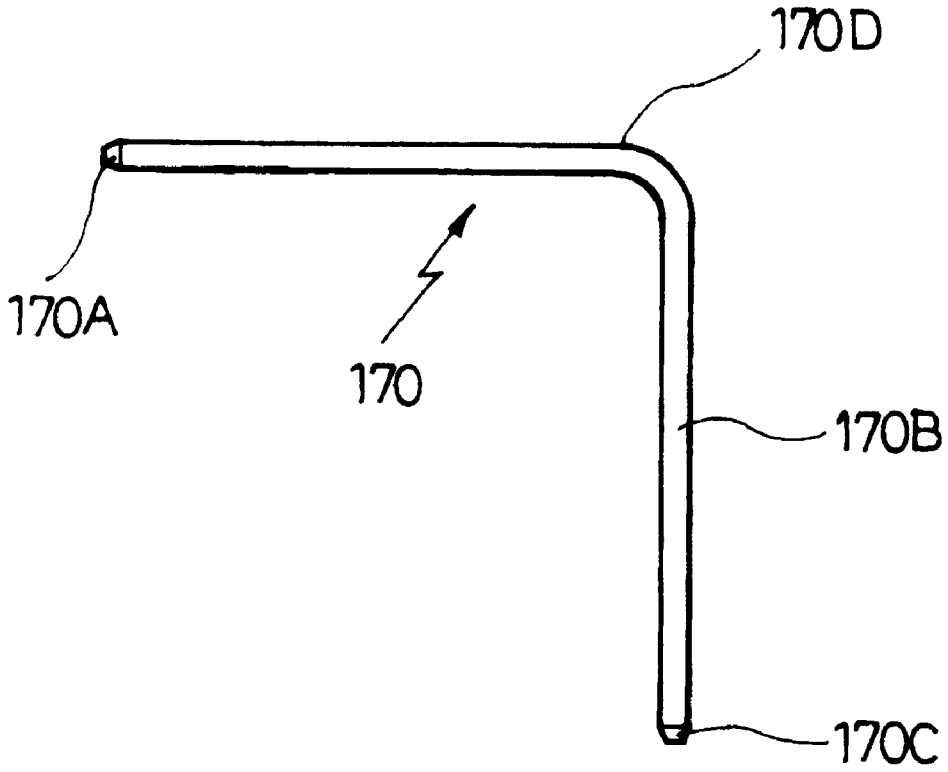
Figure 1:
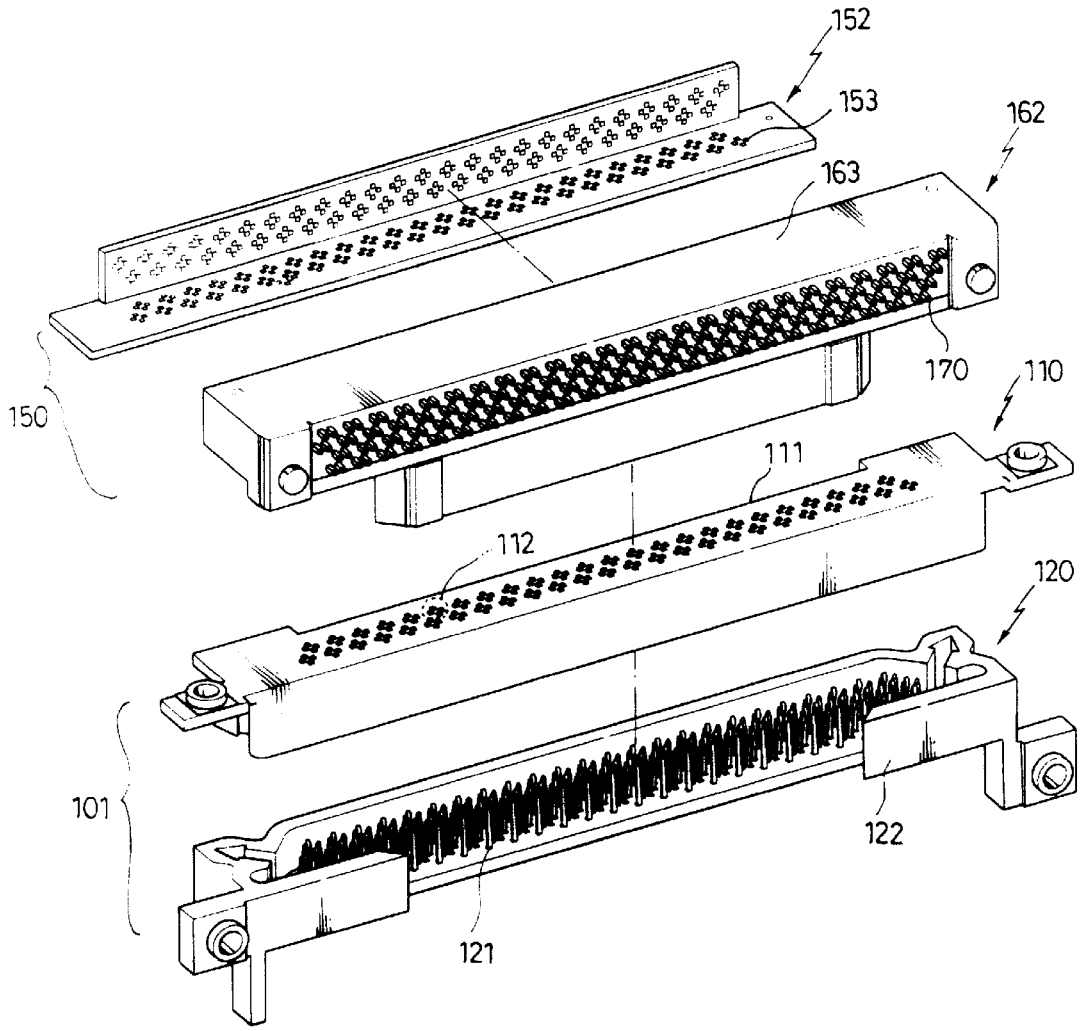
Figure 1:
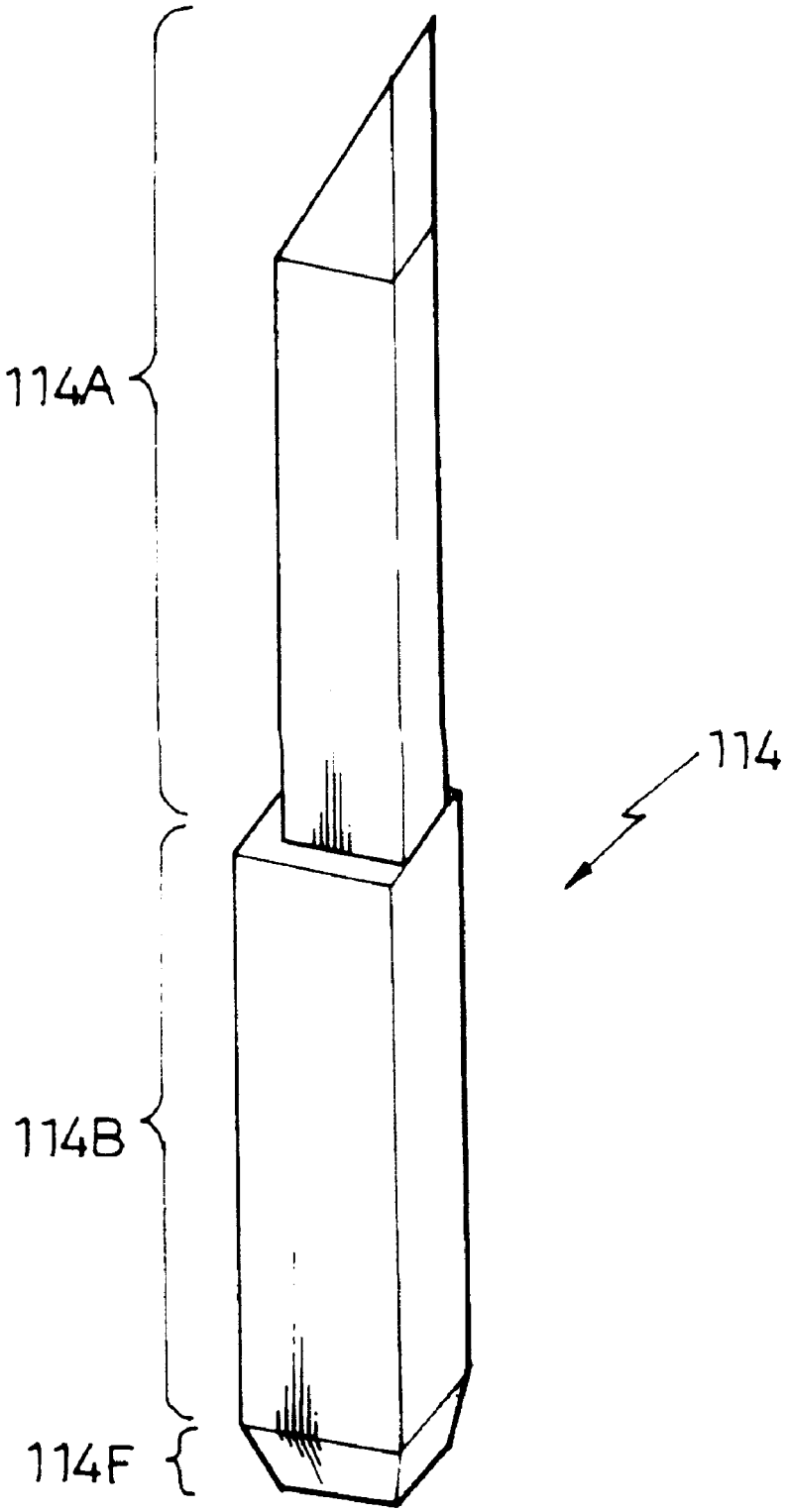

The projection-type contact groups 112 are arranged in a constant row and column so as to maintain enough insulation clearance between the respective contact groups 112, as seen in FIG. 11. Therefore, with the help of such an arrangement, a high density electric interconnecting system which can be usefully applied to a high integrated system is realized.

FIG. 9 shows a partial perspective view of a projection-type conductor contact group according to the present embodiment.

As shown in FIG. 9, a projection-type conductor contact group 112 includes a central insulation buttress 113 positioned in the central part and plural conductor posts 114 positioned around the insulation buttress, with the posts being opposed to each other.

The insulation body 111 and insulation buttress 113 act to insulate the conductor posts 114 from one another, so that different electric signals can be transmitted to the respective conductor posts 114.

The insulation buttress 113 with conductor posts 114 are attached to the insulation body 111. The discrete conductor posts 114 are electrically insulated by the insulation buttress 113 and insulation body 111.

The insulation buttress 113 and insulation body 111 are integrally molded from a single insulating material. Preferably, the insulating material used for the insulation buttress 113 and insulation body 111 is a liquid crystal polymer with an insulating property which exhibits no shrinkage during the molding process.

The conductor posts 114 are mounted on the insulation body 111 through the holes formed on the insulation body.

As seen from FIG. 9, the insulation buttress 113 comprises an extended part 113A with a rectangular cross section and a tip part 113B on the top of the extended part.

A projection-type conductor contact group 112 is composed of plural conductor posts 114 attached around an insulation buttress 113. The conductor posts 114 are so arranged that conductor posts face the other conductor posts in pairs around the central insulation buttress 113. In the case of insulation buttress with a rectangular cross section, the adjacent conductor posts are offset to each other at a right angle.

Each conductor post 114 of a projection-type conductor contact group comprises three parts, that is, the contact part 114A, stabilizing part 114B and foot part 114C.

The contact parts 114A of a conductor post 114 are positioned close to the insulation buttress 113 as seen in FIG. 9. The stabilizing part 114B is the part of the conductor post with which the conductor post is fixed to the insulation body 111. The foot part 114C is positioned on the opposite side of the contact part 114A and is extended below the insulation body 111 when mounted.

A foot part 114C may have a variety of shapes as seen in FIGS. 1*a* to 10*c*.

The conductor post 114 as shown in FIG. 10*a* is intended for the case where the external device to be connected to the first fixed connecting member 110 is a printed circuit board, which is arranged parallel to the first fixed connecting member 110, and the conductor posts 114 are soldered to the surface of the printing circuit board.

The conductor post 114 as shown in FIG. 10*b* is intended for the case where the external device to be connected to the first fixed connecting member 110 is a printed circuit board, which is arranged parallel to the first fixed connecting member 110, and the conductor posts 114 are fitted in the through holes formed on the surface of the printed circuit board.

Figure 10C:
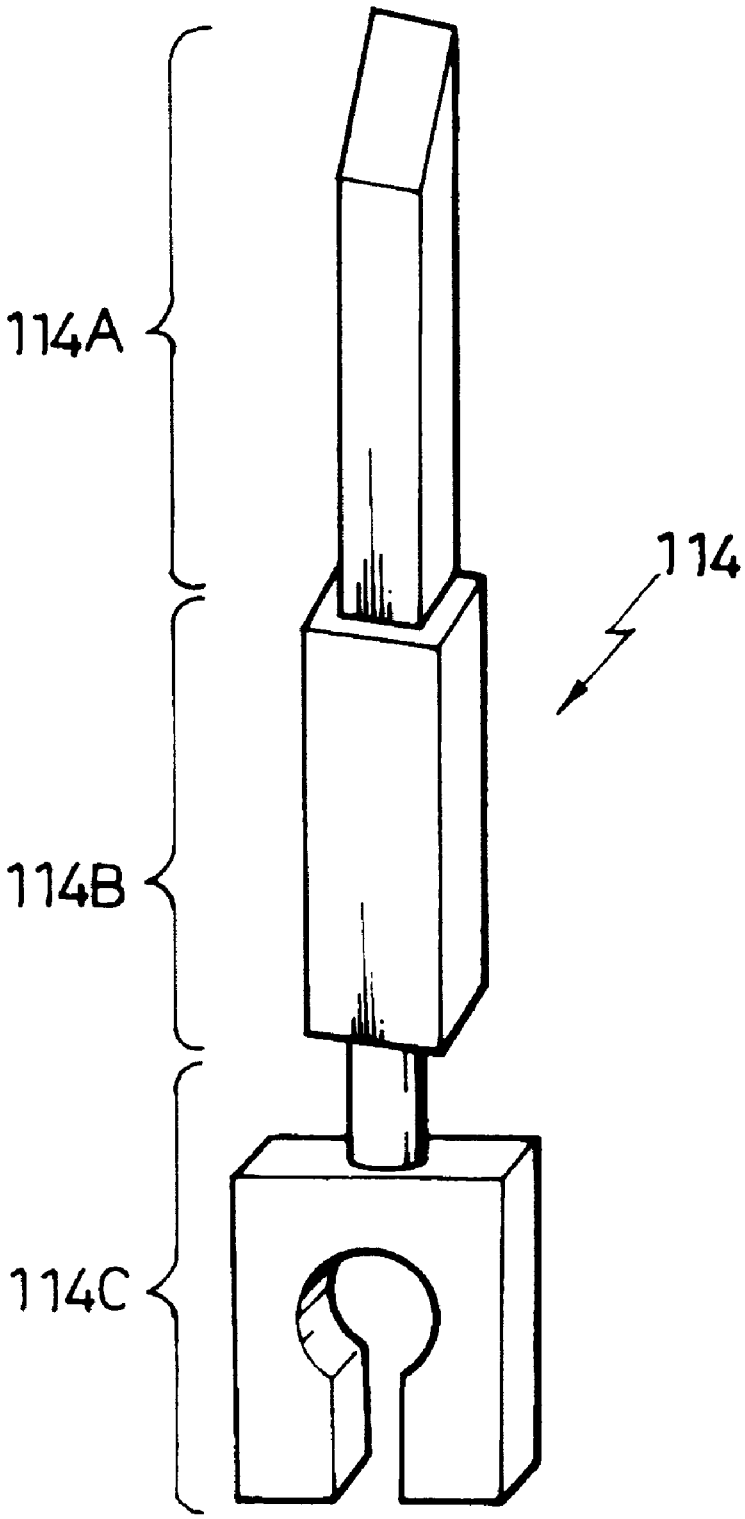

The conductor post 114 as shown in FIG. 10*c* is suited for the case where the external device to be connected to the first fixed connecting member 110 is a wire or round cable.

The stabilizing part 114B is fixed to the insulation body 111. This part 114B acts to prevent the conductor post from twisting or displacement during the handling, connecting and manufacturing process. This stabilizing part 114B may have such a dimension as to dip the conductor post in the insulation body 111 to maintain a proper insulation spacing between the adjacent conductor posts.

In addition, the conductor posts 114 may have various shapes with a cross section of rectangle, triangle, semicircle and the like.

In FIG. 7, when the projection-type conductor contact groups 112 of the first fixed connecting member 110 are received in the reception-type conductor contact groups 121 of the second fixed connecting member 120, the electric signals are transmitted through the contact parts 114A, stabilizing parts 114B and foot parts 114C to the connected device (not shown).

The conductor posts 114 are made of beryllium copper, phosphor copper, brass or other copper alloys and plated with tin, gold or palladium or a combination of two or more from tin, gold and palladium. The conductor post may be plated on its entire surface or only on the particular portion which comes in contact with the conductor contact of the reception-type conductor contact group 121, when a projection-type conductor contact group 112 is received in a reception-type conductor contact group 121.

In the present embodiment, it is assumed that the external device which is connected to the first fixed connecting member 110 is a printed circuit board, which circuit board is arranged parallel to the first fixed connecting member 110, and the conductor posts 114 are soldered to the surface of the printed circuit board.

Next, the second fixed connecting member 120 according to the first embodiment will be described with reference to FIGS. 8 as well as 12 and 13.

The second fixed connecting member 120 according to the first embodiment includes an insulation body 122 and a plurality of reception-type conductor contact groups 121 fixed to the insulation body. The reception-type conductor contact groups 121 each have a plurality of conductor flexible beams 123. The reception-type conductor groups 121 are so constructed as to receive the projection-type conductor contact groups 112 in the space enclosed by the conductor flexible beams 123.

In other words, the reception-type conductor groups 121 are arranged in such a manner that conductor flexible beams 123 face one another around an arbitrary axis and they are mutually positioned in an offset relation.

In FIGS. 11 and 12, four of the conductor flexible beams 123 are positioned so that the beams directly face one another around the central space, and so a beam forms a right angle with its adjacent beams.

The insulation body 122 acts to electrically separate the conductor beams 123 so that different electrical signals may be transmitted to respective beams.

FIG. 11 is a plan view of the second fixed connecting member 120 shown in FIG. 7, as viewed in the direction of arrow mark II.

As seen in FIG. 8, the reception-type conductor groups 121 are arranged in a row and column to receive the projection-type conductor groups 112.

FIG. 12 shows the cross section of the second fixed connecting member depicted in FIG. 11 along the line IV—IV.

As seen from FIG. 12, the respective flexible beams 123 are inserted through the holes 124 formed on the insulation body 122 and fixed to the insulation body at an essentially right angle.

FIG. 13 shows the enlarged perspective view of a flexible beam 123 depicted in FIGS. 11 and 12.

Referring to FIG. 13, each flexible beam 123 includes the contact part 123A, stabilizing part 123B and joining part 123C.

The contact part 123A is a part which comes in contact with a conductor post 114, when a projection-type conductor contact group 112 is received in a reception-type conductor contact group 121. In addition, the contact part 123A consists of an interface portion 123AA and a lead-in portion 123AB.

The interface portion 123AA is practically the part which contacts the contact portion 114A of the projection-type conductor post 114 when a projection-type and reception-type contact groups 112 and 121 are combined with each other.

The lead-in portion 123AB includes a sloped surface 125 which initializes the separation or spread of flexible beams 123 when the insulation buttress of the projection-type conductor contact group 112 starts insertion with its tip portion 113B for touching the flexible beams(or the projection-type conductor posts 114 themselves start insertion for contacting, if no insulation buttress is used). Therefore, the lead-in portion 123AB contributes to reduce the force required in inserting the projection-type conductor contact group 112 in the reception-type conductor contact group 121.

The stabilizing portion 123B is fixed to the insulation body 122. This part acts to prevent the conductor post from twisting or displacement during the handling, connecting and manufacturing process. This stabilizing part 123B may have such a dimension as to dip the beam in the insulation body 122 to maintain a proper insulation spacing between the adjacent beams.

The joining portion 123C is an area which is electrically connected to the connection portion 170A of a intermediate connecting member 150 to be explained later. Preferably, the joining portion 123C is connected to the connection portion 170A of a intermediate connecting member 150 through a proper soldering. That is, the joining portion 123C is an area for joint through soldering.

Referring to FIGS. 12 and 13, the flexible beams 123 are bent toward the opposing beams around a definite central space. The figures show the construction before a projection-type conductor contact group 112 is received in a reception-type conductor contact group 121.

On the other hand, when the projection-type conductor contact group 112 is received in the corresponding reception-type conductor contact group 121, the respective flexible beams 114 forming the reception-type conductor contact group 121 are opened warping backward.

The material constituting the insulation body 122 is preferably a liquid crystal molecule as an insulator which exhibits no shrinkage during a molding process.

The flexible beams 123 are made of beryllium copper, phosphor copper, bronze or other copper alloys and their contacting portions are plated with tin, gold or palladium. The joining portions 123C are made of the alloy usable for soldering.

Now, the intermediate connecting member 150 for the present embodiment will be described with reference to FIGS. 14*a* to 16.

As can be understood from FIGS. 7 and 14, the intermediate connecting member for the present embodiment includes a intermediate connecting member 162 and a guide cover 152 for covering the conductor pins 170 which are fixedly mounted on the intermediate connecting member 162.

The intermediate connecting member 162 includes an insulation body and a plurality of conductor pins 170 which are fixed to the insulation body by inserting through the holes on the insulation body. The insulation body is provided with a bending support 172 for bending the conductor pins 170 at a right angle. The bending support 172 is formed with the intention to bend the conductor pins 170 uniformly. This bending support 172 is formed in form of steps to meet the situation that the conductor pins 170 have different sites of bending according to their locations. This bending support 172 is formed integrally with the insulation body through molding.

The conductor pins 170 are inserted through the holes formed on the insulation body and bent at a right angle at the location of bending support 172. FIG. 14*a* shows an intermediate connecting member 150 which is useful for the case that two printed circuit board are provided perpendicular to each other. Thus, when two printed circuit boards are provided parallel to each other as in FIG. 14*b* or 14*c*, the bending support for bending conductor pins is not needed.

The guiding connecting cover 152 serves the purpose of guiding so that the conductor pins 170 may be exactly aligned with the joining portions 123C of flexible beams 123 in the second fixed connecting member 120. This guiding connecting cover 152 is provided with guiding holes 153 for aligning the connecting portions 170A of conductor pins 170 with the joining portions 123C of flexible beams 123.

The conductor pins 170 which are fixed in the insulation body 163 of the intermediate connecting member 162 have the shape as shown in FIG. 16. For the sake of convenience, the conductor pins 170 interposed inside the intermediate connecting member 162 as shown in FIG. 14*a* will be taken as the example for explanation.

The conductor pin 170 consists broadly of three parts. That is, a conductor pin comprises the connecting portion 170A, stabilizing portion 170B and foot portion 170C.

The connecting portion 170A is designed to be soldered to a joining portion 123C of a flexible beam in a second fixed connecting member 120 so as to make an electrical connection between a second fixed connecting member 120 and a intermediate connecting member 150.

The stabilizing portion 170B is the area which is fixed in an insulation body 163 to prevent a connecting portion 170A from displacement. In such a case as FIG. 14*a*, the stabilizing portion 170B is bent at a right angle at the location of a bending support 172 in form of steps, which bending support is formed inside an insulation body 163. Therefore, the stabilizing portion 170B of a conductor pin 170 to be installed in a intermediate connecting member 150 as shown in FIG. 14*a* needs presence of a bending point 170D.

In a conductor pin 170 having the bending point 170D, one or lower side is designated as the stabilizing portion 170B and the other or upper side as the connecting portion 170A.

The foot portion 170C may have various shapes as may be found in FIGS. 14*a* to 14*c* according to the types of the external devices which are connected to the intermediate connecting member 150. In other words, FIG. 14*a* shows conductor pins or foot portions useful for the case that two printed circuit boards are arranged at a right angle. FIG. 14*b* shows conductor pins or foot portions useful for the case that two printed circuit boards are arranged in a parallel relation. And FIG. 14*c* shows conductor pins or foot portions useful for the case that a printed circuit board and wires or cables are electrically connected. Thus the foot portion 170C of a conductor pin installed in a intermediate connecting member 150 may vary in its type according to that of a device to be connected.

As described above, a intermediate connecting member 150 is installed between a second fixed connecting member 120 and an external device such as a printed circuit board, semiconductor chip, wires, round cables, flat flexible cables or the like to intermediate between the two.

The second fixed connecting member 120 can always have an identical construction independent of the types of external devices. Therefore, when the type of external device is changed, it is simply necessary to change the design of the intermediate member 150 which is interposed between the second fixed connecting member 120 and the external device.

For example, while in the conventional art, the change in a device to be connected to the second fixed connecting member 120 necessitated the change in the configuration of the second fixed connecting member 120 itself, in the present embodiment, one of the intermediate connecting members 150 as shown in FIGS. 14*a* to 14*c* needs to be chosen, keeping the second fixed connecting member 120 intact. As a matter of course, intermediate connecting members for the present embodiment are not restricted to those configurations as shown in FIG. 14.

Particularly, in the conventional art, in which external devices, particularly two printed circuit boards, are arranged at a right angle, in inserting flexible beams in an insulation body of a second fixed connecting member, it is almost impossible to evenly adjust the foot portions which extended under the insulation body, as the flexible beams should be bent at a right angle and at the same time a layout of flexible beams offset at a right angle should be maintained.

However, when the intermediate connecting member 150 as in the present embodiment is used, the flexible beams 123 of the second fixed connecting member 120 would not need any bending operation, whereby the conventional problem of evenness or uniformity with the joining portions of flexible beams is eliminated. The manufacture of a intermediate connecting member 150 is also simple, because arranging conductor pins 170 offset at a right angle is not necessary.

Specially, conductor pins 170 can be bent perpendicularly with the aid of the bending support 172 as seen in FIG. 14*a*, a uniform and even arrangement of foot portions 170C in manufacturing is made possible.

In the following, the assembling operation of the electrical interconnecting system according to the present embodiment will be described by referring to FIGS. 7 and 15.

First, to a external device, for example a printed circuit board, with a surface, there are connected the conductor posts 114 of a first fixed connecting member 110 through the foot portions 114 by soldering. The projection-type conductor contact groups 112 of the first fixed connecting member 110 are caused to be received in the reception-type conductor contact groups 121 of a second fixed connecting member 120. At this time, the flexible beams 123 of respective reception-type conductor contact groups 121 are opened from other flexible beams springing backward. Then, the flexible beams 123 of the second fixed connecting member 120 are caused, through the joining portions 123C, to be fitted in the guiding holes 153 on the guiding connecting cover 152 of a properly chosen intermediate connecting member 150 and electrical connections to the conductor pins 170 of the intermediate connecting member 150 are formed through the connecting portions 170A by soldering.

Thereupon, to the foot portions 170C of the conductor pins 170, there is connected a external device corresponding to the type of the foot portions 170C. In such a manner, two or more external devices, electrically separated from one another, can be mutually connected.

As can be understood from the above description on the first embodiment, various types of connections such as a vertical type board-to-board connection, a horizontal type board-to-board connection and a board-to-wire connection may be realized by properly choosing a intermediate connecting member 150 without any need to change the shape of a first and/or second fixed connecting member 110 and/or 120.

Next, the electrical interconnecting system according to the second embodiment of the present invention will be described with reference to FIGS. 17 to 19. The same members as in the first embodiment will be given the identical numbers.

The Second Embodiment

The second embodiment of the present invention is essentially based on the same principle as the first embodiment. The only difference resides in that a intermediate connecting member 150 is located between a first fixed connecting member 110 and a external device in this embodiment in contrast to the first embodiment where the intermediate connecting member 150 is located between a second fixed connecting member 120 and a external device.

Therefore, this second embodiment is essentially the same as the first embodiment with the exception that the location of the intermediate connecting member 150 is changed.

Thus, in the following, the description on the same constructions as in the first embodiment is omitted.

First, FIG. 17 shows an exploded perspective view of an electric interconnecting system according to the second embodiment of the invention.

As seen in FIG. 17, in this embodiment, the intermediate connecting member 150 is located between a first fixed connecting member 110 and an external device.

Accordingly, a conductor post 114 of a first fixed connecting member 110 has the shape as shown in FIG. 18.

That is, the conductor post 114 has three portions, i. e. a contact portion 114A, stabilizing portion 114B and joining portion 114F. The contact portion 114A and stabilizing portion 114B have the same function and role as the contact portion 114A and stabilizing portion 114B of the conductor post 114 in the first embodiment.

The joining portion 114F is the place which is connected through soldering to the connecting portion 170A of a conductor pin 170 in an intermediate connecting member 150.

Figure 19B:
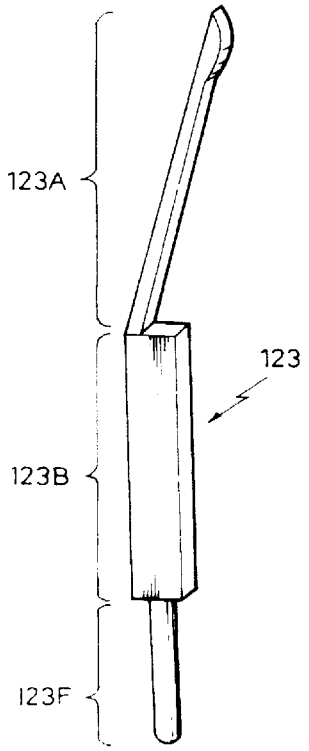
Figure 19C:
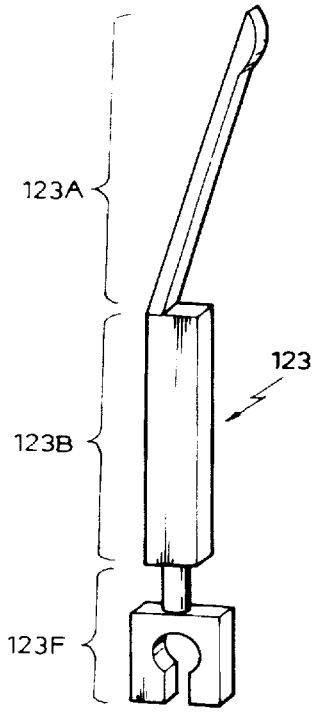
Figure 2:
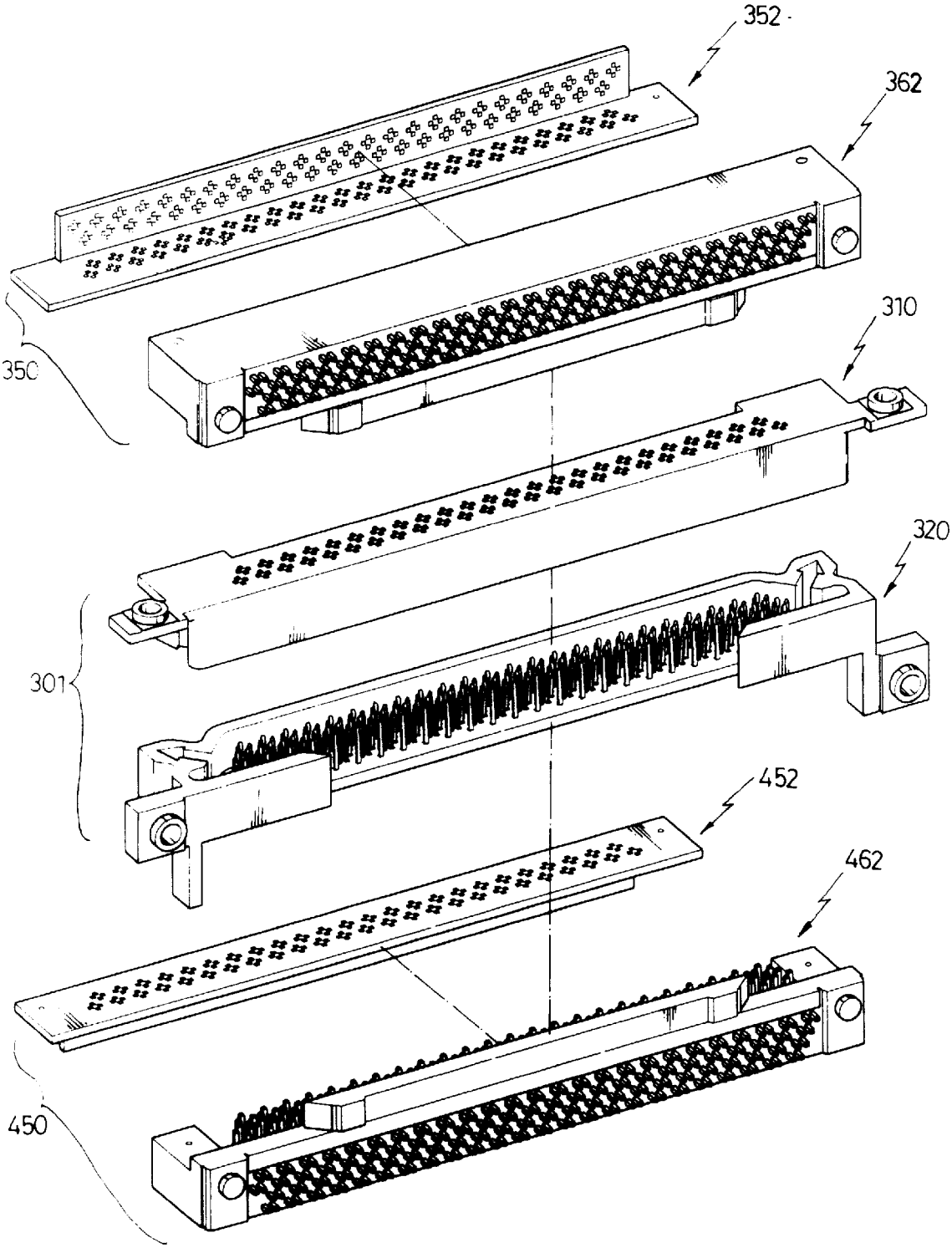
Figure 2:
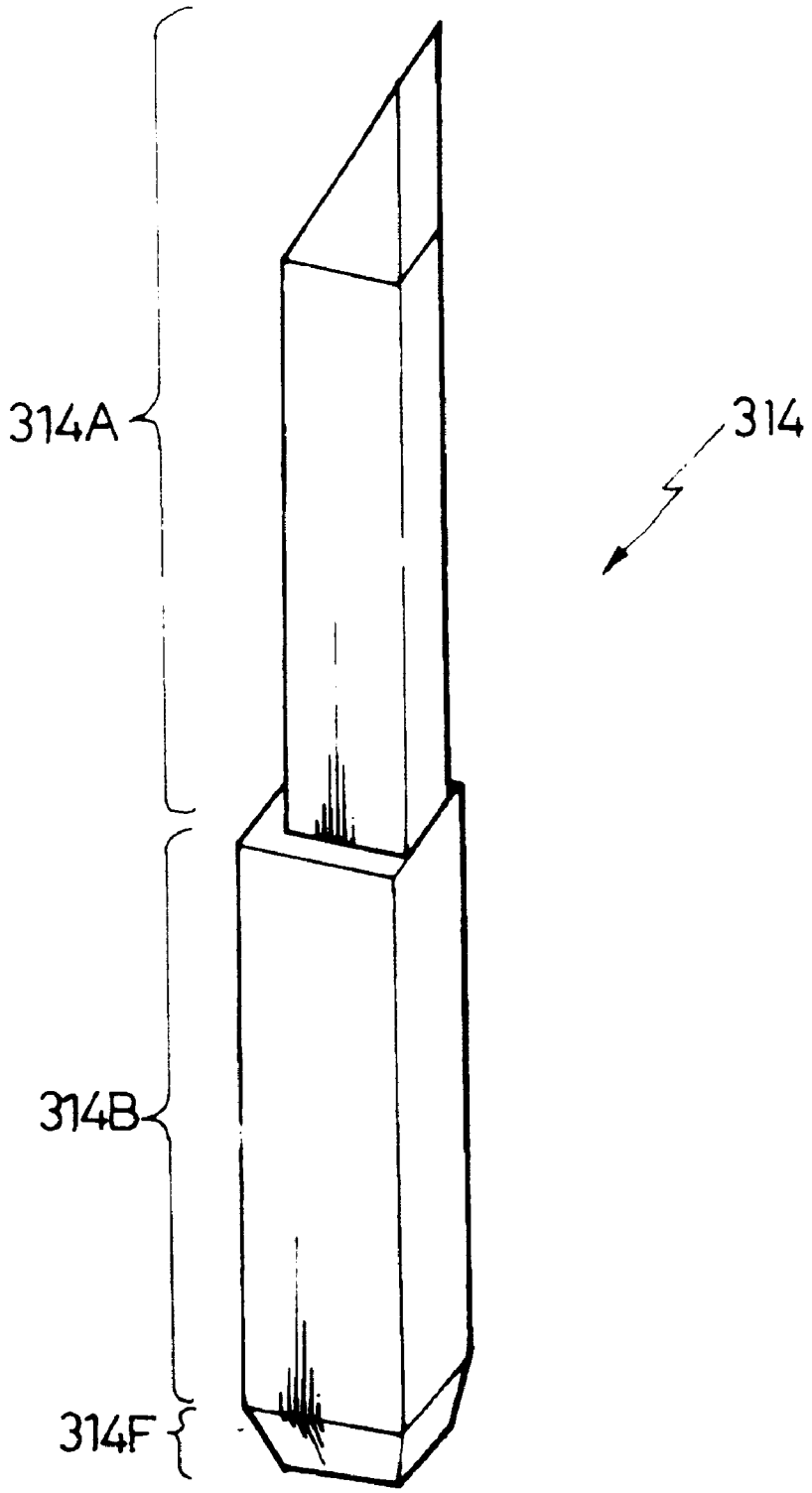

Furthermore, the flexible beams 123 of a second fixed connecting member 120 according to the present embodiment have a construction as shown in FIGS. 19*a* to 19*c* according to the type of the relevant external device. As shown in FIG. 19, the flexible beams 123 according to the present embodiment have each a contact portion 123A, stabilizing portion 123B and foot portion 123F, as the conductor beams 114 in the first embodiment. The foot portion 123F should vary in its shape according to the type of an external device which is connected to the second fixed connecting member 120, as depicted in FIGS. 19*a* to 19*c*.

As described above, in the present embodiment, the second fixed connecting member 120 is attached with a device having a surface by way of soldering, with which second fixed connecting member a first fixed connecting member 110 is combined. To the first fixed connecting member 110 is connected an intermediate connecting member 150 which varies in its configuration according to the type of a relevant connecting device.

Therefore, in this second embodiment as well, a vertical type board-to-board connection, horizontal type board-to-board connection, board-to-wire connection or other similar connection can be easily carried out by properly changing the intermediate connecting member 120.

Finally, the third embodiment of the present invention will be described with reference to FIGS. 20 to 22.

The Third Embodiment.

The third embodiment of the present invention relates to the case of arrangement wherein a first intermediate connecting member 350 is interposed between a first fixed connecting member 310 and an external device while a second intermediate connecting member 450 is interposed between a second fixed connecting member 320 and an external device.

Figure 22:
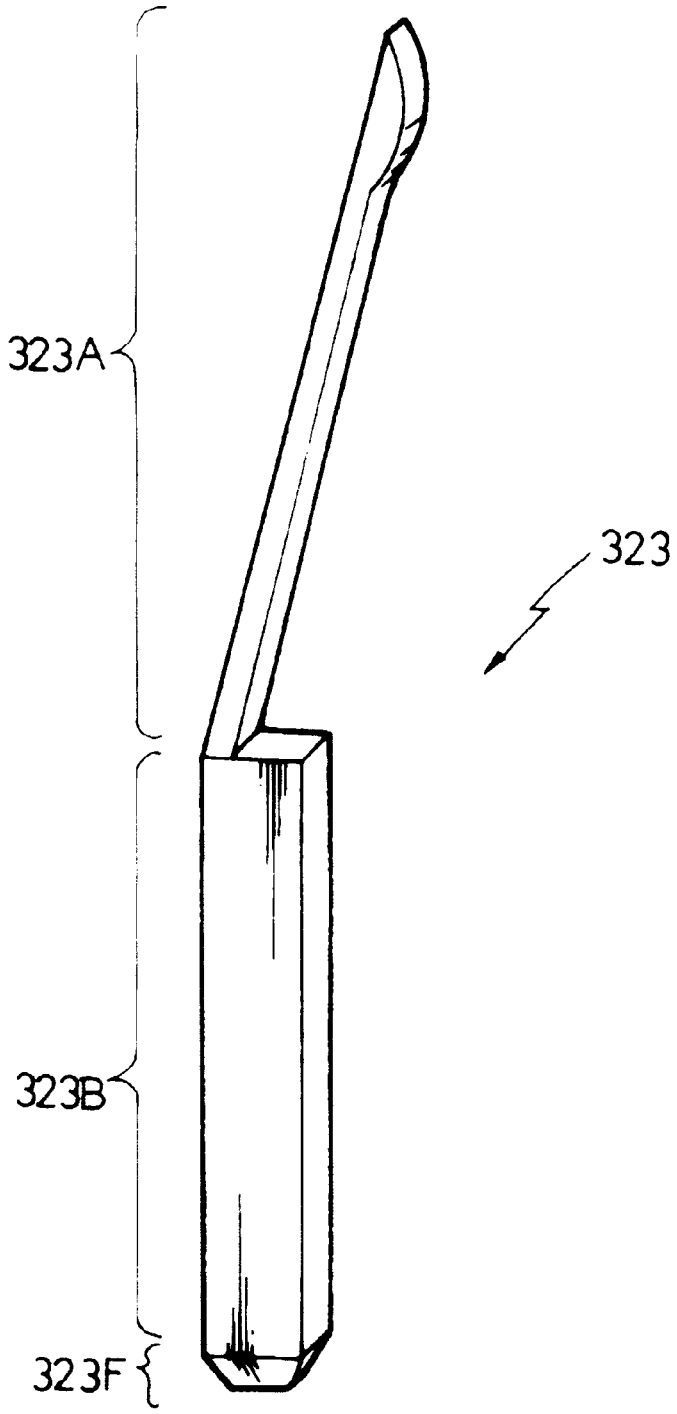
FIG. 22 shows an enlarged perspective view of a flexible beam applicable to the second fixed connecting member as depicted in FIG. 20.

Thus, the conductor post 314 and the conductor flexible beam 323 usable for the first and second fixed connecting members 310 and 320 have the shape as shown in FIGS. 21 and 22 respectively.

In other words, the conductor post 314 shown in FIG. 21 and the flexible beam 323 shown in FIG. 22 have each a contact portion 314A or 323A, stabilizing portion 314B or 323B and joining portion 314F or 323F. The joining portions 314F and 323F are to be connected to the first and second intermediate connecting member 310 and 320 by soldering.

The rest of construction for this embodiment is essentially the same as that for the first or second embodiment.

As described above, the third embodiment of the present invention permits the unvaried constant shapes of the first and second fixed connecting members 310 and 320 independent of the type of the devices to be connected to those connecting members 310 and 320. In addition, in this third embodiment as well, a vertical type board-to-board connection, horizontal type board-to-board connection, board-to-wire connection or other similar connection can be easily carried out by properly choosing the shapes of the first and/or second intermediate members 350 and/or 450 which are connected to the first and second fixed connecting members 310 and 320.

As would be evident from the description given above, the electric interconnecting system according to the present invention, in contrast to the conventional art, can be adapted for the varying connecting environment by changing the intermediate connecting member as an exchangeable connecting part in accordance with the type of interface devices and the interfacing arrangement.

It is to be understood that, while the invention was described with respect to some specific embodiments, the invention is never restricted to those embodiments and a variety of modifications and alterations would be possible to a man skilled in the art by referring to the description or drawings presented here and within the spirit of the invention and thus those modifications or alterations are to fall within the scope of the invention, which scope should be limited only by the attached claims.

As would be clear from the foregoing description, the present invention can cope with the varying connecting environment actively and flexibly by constructing the electric interconnecting system as a discrete form which comprises a fixed part(s) assuming a constant shape(s) irrespective of the type of a device(s) to be connected and an exchangeable part(s) which can be changed in the type according to the type of a device(s) to be connected.

What is claimed is:

1. An electric interconnecting system, comprising:

a first fixed connecting member including an insulation body and a plurality of projection-type conductor contact groups, the projection-type conductor contact groups being inserted in and fixed on the insulation body and disposed in rows and columns;

a second fixed connecting member including an insulation body and a plurality of reception-type conductor contact groups, the reception-type conductor contact groups being inserted in and fixed on the insulation body and disposed in rows and columns to receive corresponding projection-type conductor contact groups; and an intermediate connecting member interposed between an external device to be connected and said second fixed connecting member to electrically interface the two; wherein the conductor contacts forming the conductor contact groups of said second fixed connecting member include joining portions to extend beyond said insulation body to thereby be electrically connected to said intermediate connecting member;

said external device is electrically connectable to another external device, wherein said another external device is otherwise electrically separated from said external device and wherein said another external device is electrically connected to said first fixed connecting member, by causing the projection-type conductor contact groups of the first fixed connecting member to be fixedly received in the reception-type conductor contact groups of the second fixed connecting member and causing the intermediate connecting member to be interposed between the second fixed connecting member and said external device to electrically connect the second fixed connecting member and said external device; and wherein shape and configuration of said intermediate connecting member are changeable to correspond to said external device.

2. An electric interconnecting system comprising, a first fixed connecting member including an insulation body and a plurality of projection-type conductor contact groups, the projection-type conductor contact groups being inserted in and fixed on the insulation body and disposed in rows and columns;

a second fixed connecting member including an insulation body and a plurality of reception-type conductor contact groups, the reception-type conductor contact groups being inserted in and fixed on the insulation body and disposed in rows and columns to receive corresponding projection-type conductor contact groups; and an intermediate connecting member interposed between an external device to be connected and said second fixed connecting member to electrically interface the two; wherein the conductor contacts forming the conductor contact groups of said second fixed connecting member include joining portions to extend beyond said insulation body to thereby be electrically connected to said intermediate connecting member;

said external device is electrically connectable to another external device, wherein said another external device is otherwise electrically separated from said external device and wherein said another external device is electrically connected to said first fixed connecting member, by causing the projection-type conductor contact groups of the first fixed connecting member to be fixedly received in the reception-type conductor contact groups of the second fixed connecting member and causing the intermediate connecting member to be interposed between the second fixed connecting member and said external device to electrically connect the second fixed connecting member and said external device; and wherein shape and configuration of said intermediate connecting member are changeable to correspond to said external device; and wherein said intermediate connecting member includes an insulation body and a plurality of conductor pins inserted and fixed in the insulation body;

the conductor pins each have a connecting portion for connection to the joining portion of a conductor contact of said second fixed connecting member, a stabilizing portion fixed in said insulation body to prevent said connecting portion from displacing, and a foot portion having a shape corresponding to said another external device to combine with it, said foot portion being located under the insulation body and joined to said stabilizing portion.

3. The electric interconnecting system according to claim 2, wherein said foot portion has a flat end to interface one of a wire, a flat flexible cable, a round cable and a surface of an interfacing device.

4. The electric interconnecting system according to claim 3, wherein said foot portion has a curved surface end to interface a plate hole formed on a printing circuit board.

5. An electric interconnecting system, a first fixed connecting member including an insulation body and a plurality of projection-type conductor contact groups, the projection-type conductor contact groups being inserted in and fixed on the insulation body and disposed in rows and columns;

a second fixed connecting member including an insulation body and a plurality of reception-type conductor contact groups, the reception-type conductor contact groups being inserted in and fixed on the insulation body and disposed in rows and columns to receive corresponding projection-type conductor contact groups; and an intermediate connecting member interposed between an external device to be connected and said second fixed connecting member to electrically interface the two; wherein the conductor contacts forming the conductor contact groups of said second fixed connecting member include joining portions to extend beyond said insulation body to thereby be electrically connected to said intermediate connecting member;

said external device is electrically connectable to another external device wherein said another external device is otherwise electrically separated from said external device and wherein said another external device is electrically connected to said first fixed connecting member, by causing the projection-type conductor contact groups of the first fixed connecting member to be fixedly received in the reception-type conductor contact groups of the second fixed connecting member and causing the intermediate connecting member to be interposed between the second fixed connecting member and said external device to electrically connect the second fixed connecting member and said external device; and wherein shape and configuration of said intermediate connecting member are changeable to correspond to said external device, and wherein the conductor contact groups of the first and second fixed connecting members are each a group of plural conductor contacts, facing one another around an arbitrary axis.

6. The electric interconnecting system according to claim 5, wherein the conductor contacts forming a projection-type conductor contact group in said first fixed connecting member are each a conductor post, and the conductor contacts forming a reception-type conductor contact group in said second fixed connecting member are each a conductor flexible beam.

7. The electric interconnecting system according to claim 5, wherein the projection-type conductor contact group in said first fixed connecting member comprises:

an insulation buttress disposed perpendicular to said insulation body in the central area, and a plurality of conductor contacts disposed around said insulation buttress, with conductor contacts facing one another.

8. The electric interconnecting system according to claim 7, wherein the conductor contacts forming a projection-type conductor contact group each include:

a contact portion to be in contact with the contact of a corresponding reception-type conductor contact group, when projection-type conductor contact groups are received in the corresponding reception-type conductor contact groups, a stabilizing portion to be fixed in said insulation body to prevent said contact portion from displacing, and a foot portion being located under the insulation body and joined to said stabilizing portion to perform a function of electric interface, said foot portion having a shape corresponding to said another external device.

9. The electric interconnecting system according to claim 8, wherein said foot portion has a flat end to interface one of a wire, a flat flexible cable, a round cable and a surface of an interfacing device.

10. The electric interconnecting system according to claim 8, wherein said foot portion has a curved surface end to interface a plate hole formed on a printing circuit board.

11. The electric interconnecting system according to claim 5, wherein the conductor contacts forming a reception-type conductor contact group are deflected toward one another around an arbitrary axis before a corresponding projection-type conductor contact group is received in them.

12. The electric interconnecting system according to claim 5, wherein the conductor contacts forming a reception-type contact group are deflected away from one another around an arbitrary axis after a corresponding projection-type conductor contact group is received in them.

13. The electric interconnecting system according to claim 5, wherein the conductor contacts forming a reception-type conductor contact group each includes:

a contact portion to be in contact with a contact of the corresponding projection-type conductor contact group, when projection-type conductor contact groups are received in the corresponding reception-type conductor contact groups, a stabilizing portion to be fixed in said insulation body to prevent said contact portion from displacing, and a joining portion joined to said stabilizing portion and to be positioned under said insulation body, said joining portion having a permanent shape to be electrically connected to said intermediate connecting member.

14. The electric interconnecting system according to claim 13, wherein said joining portion is a joining portion for solder joint.

15. The electric interconnecting system according to claim 13, wherein said contact portion comprises:

a lead-in portion having a sloped surface to decrease the inserting force, when projection-type conductor contact groups are received in corresponding reception-type conductor contact groups and an interface portion for substantially contacting the contact portion of one of conductor contacts forming the projection-type conductor contact group, when projection-type conductor contact groups are received in corresponding reception-type conductor contact groups.

16. The electric interconnecting system according to claim 1, wherein said insulation body in said first and second fixed connecting member as well as said intermediate connecting member comprises a liquid crystal polymer of electric insulating material.

17. An electric interconnecting system, comprising:

a first fixed connecting member including an insulation body and a plurality of projection-type conductor contact groups being inserted in and fixed on the insulation body and disposed in rows and columns;

a second fixed connecting member including an insulation body and a plurality of reception-type conductor contact groups, the reception-type conductor contact groups being inserted in and fixed on the insulation body and disposed in rows and columns to receive corresponding projection-type conductor contact groups; and an intermediate connecting member interposed between an external device to be connected and said first fixed connecting member to electrically interface the two; wherein the conductor contacts forming the conductor contact groups of said fixed first connecting member include joining portions to extend beyond said insulation body to thereby be electrically connected to said intermediate connecting member;

said external device is electrically connectable to another external device, wherein said another external device is otherwise electrically separated from said external device and wherein said another external device is electrically connected to said second connecting member, by causing the projection-type conductor contact groups of the first fixed connecting member to be fixedly received in the reception-type conductor contact groups of the second fixed connecting member and causing the intermediate connecting member to be interposed between the first fixed connecting member and said external device to electrically connect the first fixed connecting member and said external device; and wherein shape and configuration of said intermediate connecting member are changeable to correspond to said external device.

18. An electric interconnecting system comprising, a first fixed connecting member including an insulation body and a plurality of protection-type conductor contact groups being inserted in and fixed on the insulation body and disposed in rows and columns;

a second fixed connecting member including an insulation body and a plurality of reception-type conductor contact groups, the reception-type conductor contact groups being inserted in and fixed on the insulation body and disposed in rows and columns to receive corresponding projection-type conductor contact groups; and an intermediate connecting member interposed between an external device to be connected and said first fixed connecting member to electrically interface the two; wherein the conductor contacts forming the conductor contact groups of said fixed first connecting member include joining portions to extend beyond said insulation body to thereby be electrically connected to said intermediate connecting member;

said external device is electrically connectable to another external device, wherein said another external device is otherwise electrically separated from said external device and wherein said another external device is electrically connected to said second connecting member, by causing the projection-type conductor contact groups of the first fixed connecting member to be fixedly received in the reception-type conductor contact groups of the second fixed connecting member and causing the intermediate connecting member to be interposed between the first fixed connecting member and said external device to electrically connect the first fixed connecting member and said external device; and wherein shape and configuration of said intermediate connecting member are changeable to correspond to said external device, wherein said intermediate connecting member includes an insulation body and a plurality of conductor pins inserted and fixed in the insulation body;

the conductor pins each have a connecting portion for connection to the joining portion of a conductor contact of said first fixed connecting member, a stabilizing portion fixed in said insulation body to prevent said connecting portion from displacing, and a foot portion having a shape corresponding to said external device to combine with it, said foot portion being located under the insulation body and joined to said stabilizing portion.

19. The electric interconnecting system according to claim 18; wherein said foot portion has a flat end to interface one of a wire, a flat flexible cable, a round cable and a surface of an interfacing device.

20. The electric interconnecting system according to claim 18, wherein said foot portion has a curved surface to interface a plate hole formed on a printing circuit board.

21. An electric interconnecting system comprising, a first fixed connecting member including an insulation body and a plurality of projection-type conductor contact groups being inserted in and fixed on the insulation body and disposed in rows and columns;

a second fixed connecting member including an insulation body and a plurality of reception-type conductor contact groups, the reception-type conductor contact groups being inserted in and fixed on the insulation body and disposed in rows and columns to receive corresponding projection-type conductor contact groups; and an intermediate connecting member interposed between an external device to be connected and said first fixed connecting member to electrically interface the two; wherein the conductor contacts forming the conductor contact groups of said fixed first connecting member include joining portions to extend beyond said insulation body to thereby be electrically connected to said intermediate connecting member;

said external device is electrically connectable to another external device wherein said another external device is otherwise electrically separated from said external device and wherein said another external device is electrically connected to said second connecting member, by causing the projection-type conductor contact groups of the first fixed connecting member to be fixedly received in the reception-type conductor contact groups of the second fixed connecting member and causing the intermediate connecting member to be interposed between the first fixed connecting member and said external device to electrically connect the first fixed connecting member and said external device; and wherein shape and configuration of said intermediate connecting member are changeable to correspond to said external device, wherein the conductor contact groups of the first and second fixed connecting members are each a group of plural conductor contacts, facing one another around an arbitrary axis.

22. The electric interconnecting system according to claim 21, wherein the projection-type conductor contact group in said first fixed connecting member comprises:

an insulation buttress disposed perpendicular to said insulation body in the central area, and a plurality of conductor contacts disposed around said insulation buttress, with conductor contacts facing one another.

23. The electric interconnecting system according to claim 22, wherein the conductor contacts forming a projection-type conductor contact group each include:

a contact portion to be in contact with a contact of the corresponding reception-type conductor contact group, when projection-type conductor contact groups are received in the corresponding reception-type conductor contact groups, a stabilizing portion to be fixed in said insulation body to prevent said contact portion from displacing, and a joining portion joined to said stabilizing portion and to be positioned under said insulation body, said joining portion having a permanent shape to be electrically connected to said intermediate connecting member irrespective of an external device.

24. The electric interconnecting system according to claim 23, wherein said joining portion is a joining portion for solder joint.

25. The electric interconnecting system according to claim 21, wherein the conductor contacts forming a reception-type contact group are deflected toward one another around an arbitrary axis before a corresponding projection-type conductor contact group is received in them.

26. The electric interconnecting system according to claim 21, wherein the conductor contacts forming a reception-type contact group are deflected away from one another around an arbitrary axis after a corresponding projection-type conductor contact group is received in them.

27. The electric interconnecting system according to claim 21, wherein the conductor contacts forming a reception-type conductor contact group each includes:

a contact portion to be in contact with a contact of the corresponding projection-type conductor contact group, when projection-type conductor contact groups are received in the corresponding reception-type conductor contact groups, a stabilizing portion to be fixed in said insulation body to prevent said contact portion from displacing, and a foot portion having a shape corresponding to said external device to perform a function of electric interface, said foot portion being located under the insulation body and joined to said stabilizing portion.

28. The electric interconnecting system according to claim 22, wherein said foot portion has a flat end to interface one of a wire, a flat flexible cable, a round cable and a surface of an interfacing device.

29. The electric interconnecting system according to claim 22, wherein said foot portion has a curved surface to interface a plate hole formed on a printing circuit board.

30. The electric interconnecting system according to claim 27, wherein said contact portion comprises:

a lead-in portion having a sloped surface to decrease the inserting force, when projection-type conductor contact groups are received in corresponding reception-type conductor contact groups, and an interface portion for substantially contacting the contact portion of one of conductor contacts forming the projection-type conductor contact group, when projection-type conductor contact groups are received in corresponding reception-type conductor contact groups.

31. An electric interconnecting system, comprising:

a first fixed connecting member including an insulation body and a plurality of projection-type conductor contact groups, the projection-type conductor groups being inserted in and fixed on the insulation body and disposed in rows and columns;

a second fixed connecting member including an insulation body and a plurality of reception-type conductor contact groups, the reception-type conductor contact groups being inserted in and fixed on the insulation body and disposed in rows and columns to receive corresponding projection-type conductor contact groups;

a first intermediate connecting member interposed between an external device to be connected and said first fixed connecting member to electrically interface the two; and a second intermediate connecting member interposed between another external device to be connected and said second fixed connecting member to electrically interface the two; wherein the conductor contacts forming the conductor contact groups of said first and second fixed connecting members include joining portions to extend beyond the respective insulation bodies to thereby be electrically connected to said first and second intermediate connecting members;

said external device is electrically connectable to said another external device, wherein said another external device is otherwise electrically separated from said external device and wherein said another external device is electrically connected to said second intermediate connecting member, by causing the projection-type conductor contact groups of the first fixed connecting member to be fixedly received in the reception-type conductor contact groups of the second fixed connecting member and causing the first intermediate connecting member to be interposed between the first fixed connecting member and said external device to electrically connect the first fixed connecting member and said external device on one side and the second intermediate connecting member to be interposed between the second fixed connecting member and said another external device on the other side to electrically connect the second fixed connecting member and said another external device; and wherein shape and configuration of said first and second intermediate connecting members are each changeable to correspond to said external and another external device, respectively.

32. An electric interconnecting system comprising, a first fixed connecting member including an insulation body and a plurality of projection-type conductor contact groups, the projection-type conductor groups being inserted in and fixed on the insulation body and disposed in rows and columns;

a second fixed connecting member including an insulation body and a plurality of reception-type conductor contact groups the reception-type conductor contact groups being inserted in and fixed on the insulation body and disposed in rows and columns to receive corresponding protection-type conductor contact groups;

a first intermediate connecting member interposed between an external device to be connected and said first fixed connecting member to electrically interface the two; and a second intermediate connecting member interposed between another external device to be connected and said second fixed connecting member to electrically interface the two; wherein the conductor contacts forming the conductor contact groups of said first and second fixed connecting members include joining portions to extend beyond the respective insulation bodies to thereby be electrically connected to said first and second intermediate connecting members;

said external device is electrically connectable to said another external device, wherein said another external device is otherwise electrically separated from said external device and wherein said another external device is electrically connected to said second intermediate connecting member, by causing the protection-type conductor contact groups of the first fixed connecting member to be fixedly received in the reception-type conductor contact groups of the second fixed connecting member and causing the first intermediate connecting member to be interposed between the first fixed connecting member and said external device to electrically connect the first fixed connecting member and said external device on one side and the second intermediate connecting member to be interposed between the second fixed connecting member and said another external device on the other side to electrically connect the second fixed connecting member and said another external device; and wherein shape and configuration of said first and second intermediate connecting members are each changeable to correspond to said external and another external device, respectively, wherein said first and second intermediate connecting members include each an insulation body and a plurality of conductor pins inserted and fixed in the insulation body;

the conductor pins each have a connecting portion for connection to the joining portion of a conductor contact of said first or second fixed connecting member, a stabilizing portion fixed in the insulation body to prevent said connecting portion from displacing, and a foot portion having a shape corresponding to the external device to combine with it, said foot portion being located under the insulation body and joined to the stabilizing portion.

33. The electric interconnecting system according to claim 32, wherein said foot portion has a flat end to interface one of a wire, a flat flexible cable, a round cable and a surface of an interfacing device.

34. The electric interconnecting system according to claim 32, wherein said foot portion has a curved surface to interface a plate hole formed on a printing circuit board.

35. An electric interconnecting system comprising, a first fixed connecting member including an insulation body and a plurality of projection-type conductor contact groups, the projection-type conductor groups being inserted in and fixed on the insulation body and disposed in rows and columns;

a second fixed connecting member including an insulation body and a plurality of reception-type conductor contact groups, the reception-type conductor contact groups being inserted in and fixed on the insulation body and disposed in rows and columns to receive corresponding projection-type conductor contact groups;

a first intermediate connecting member interposed between an external device to be connected and said first fixed connecting member to electrically interface the two; and a second intermediate connecting member interposed between another external device to be connected and said second fixed connecting member to electrically interface the two; wherein the conductor contacts forming the conductor contact groups of said first and second fixed connecting members include joining portions to extend beyond the respective insulation bodies to thereby be electrically connected to said first and second intermediate connecting members;

said external device is electrically connectable to said another external device, wherein said another external device is otherwise electrically separated from said external device and wherein said another external device is electrically connected to said second intermediate connecting member, by causing the projection-type conductor contact groups of the first fixed connecting member to be fixedly received in the reception-type conductor contact groups of the second fixed connecting member and causing the first intermediate connecting member to be interposed between the first fixed connecting member and said external device to electrically connect the first fixed connecting member and said external device on one side and the second intermediate connecting member to be interposed between the second fixed connecting member and said another external device on the other side to electrically connect the second fixed connecting member and said another external device; and wherein shape and configuration of said first and second intermediate connecting members are each changeable to correspond to said external and another external device, respectively, wherein the conductor contact groups of the first and second fixed connecting member are each a group of plural conductor contacts, facing one another around an arbitrary axis.

36. The electric interconnecting system according to claim 35, wherein the conductor contacts forming the projection- and reception-type conductor contact groups each include:

a contact portion to be in contact with the corresponding contact of a corresponding conductor contact group, when projection-type conductor contact groups are received in the corresponding reception-type conductor contact groups, a stabilizing portion to be fixed in the insulation body to prevent said contact portion from displacing, and a joining portion joined to said stabilizing portion and to be positioned under the insulation body, said joining portion having a permanent shape to be electrically connected to the first and second intermediate connecting member irrespective of external devices.

37. The electric interconnecting system according to claim 36, wherein said joining portion is a joining portion for solder joint.

38. The electric interconnecting system according to claim 35, wherein the conductor contacts forming a reception-type conductor contact group are deflected toward one another around an arbitrary axis before a corresponding projection-type conductor contact group is received in them.

39. The electric interconnecting system according to claim 35, wherein the conductor contacts forming a reception-type conductor contact group are deflected away from one another around an arbitrary axis after a corresponding projection-type conductor contact group is received in them.

40. The electric interconnecting system according to claim 35, wherein said contact portions of the conductor contacts forming a reception-type conductor contact group each comprises:

a lead-in portion having a sloped surface to decrease the inserting force, when projection-type conductor contact groups are received in corresponding reception-type conductor contact groups, and an interface portion for substantially contacting the contact portion of one of conductor contacts forming the projection-type conductor contact group, when projection-type conductor contact groups are received in corresponding reception-type conductor contact groups.

41. The electric interconnecting system according to claim 35, wherein the projection-type conductor contact group in said first fixed connecting member comprises:

an insulation buttress disposed perpendicular to the insulation body in the central area, and a plurality of conductor contacts disposed around said insulation buttress, with conductor contacts facing one another.

* * * * *